US006796386B2

(12) United States Patent
Izumisawa et al.

(10) Patent No.: US 6,796,386 B2
(45) Date of Patent: Sep. 28, 2004

(54) PNEUMATIC ROTARY TOOL

(75) Inventors: Osamu Izumisawa, Tokyo (JP); Kunihiro Yamamoto, Tokyo (JP)

(73) Assignee: S.P. Air Kabusiki Kaisha, Nagano Pref. (JP)

( * ) Notice: Subject to any disclaimer, the term of this patent is extended or adjusted under 35 U.S.C. 154(b) by 0 days.

(21) Appl. No.: 10/130,816

(22) PCT Filed: Jul. 31, 2001

(86) PCT No.: PCT/IB01/01374

§ 371 (c)(1),
(2), (4) Date: Nov. 26, 2002

(87) PCT Pub. No.: WO02/20221

PCT Pub. Date: Mar. 14, 2002

(65) Prior Publication Data

US 2003/0136570 A1 Jul. 24, 2003

Related U.S. Application Data

(60) Provisional application No. 60/239,754, filed on Oct. 12, 2000, provisional application No. 60/233,550, filed on Sep. 19, 2000, and provisional application No. 60/231,013, filed on Sep. 8, 2000.

(51) Int. Cl.[7] ..... B25D 19/00

(52) U.S. Cl. ..... 173/93.5

(58) Field of Search ..... 173/93, 93.5, 93.6, 173/170, 171, 213, 169, 168

(56) References Cited

U.S. PATENT DOCUMENTS

| | | | | |
|---|---|---|---|---|
| 2,331,874 A | | 10/1943 | Sittert | |
| 2,569,244 A | | 9/1951 | Larson | |
| 2,581,033 A | | 1/1952 | Larson et al. | |
| 3,270,834 A | | 9/1966 | Bratt | |
| 3,443,646 A | * | 5/1969 | Baker et al. | 173/169 |
| 3,714,994 A | | 2/1973 | Zoerner et al. | |

(List continued on next page.)

FOREIGN PATENT DOCUMENTS

| | | |
|---|---|---|
| DE | 33 30 891 A1 | 3/1985 |
| EP | 0 372 376 | 6/1990 |
| EP | 0 849 052 A2 | 6/1998 |
| EP | 0 876 883 A2 | 11/1998 |
| EP | 0 885 658 A2 | 12/1998 |
| FR | 2097803 | 3/1972 |
| GB | 811252 | 4/1959 |
| GB | 1204718 | 9/1970 |
| GB | 2 149 465 | 6/1985 |
| SU | 1306889 A1 | 4/1987 |
| TW | 287457 | 10/1996 |
| TW | 287458 | 10/1996 |
| TW | 327849 | 3/1998 |
| TW | 369981 | 9/1999 |
| WO | WO 94/04312 | 3/1994 |

OTHER PUBLICATIONS

Ingersoll–Rand, Model 55P3, IR Industrial Tools E–Catalog, viewed Jan. 4, 2000, dev2opcenter.net/irecatalo . . . &ModelNo.=55p3&ReportType=Group, 1 page.

Ingersoll–Rand, Model 100PQ1, IR Industrial Tools E–Catalog, viewed Jan. 4, 2000, dev2opcenter.net/irecatalo . . . &ModelNo.=100PQ&ReportType=Group, 1 page.

PCT/US01/02785 International Search Report from the European Patent Office dated Sep. 25, 2001, 4 pages.

*Primary Examiner*—Scott A. Smith
(74) *Attorney, Agent, or Firm*—Senniger Powers

(57) ABSTRACT

A pneumatic rotary tool has a housing formed primarily from plastic so that the weight and price of the tool are substantially reduced. The air motor is formed for economic assembly while permitting greater structural stability should the housing deflect under an impact. The tool includes a torque selector which controls the amount of pressurized air allowed to enter the air motor, thereby controlling the torque output of the motor. The user may adjust the torque selector to a number of set positions which correspond to discrete torque values. The tool additionally incorporates early and late stage exhaust ports, so that backpressure within the air motor does not slow motor rotation or decrease tool power.

22 Claims, 19 Drawing Sheets

U.S. PATENT DOCUMENTS 3,827,834 A 8/1974 Kakimoto
4,379,492 A 4/1983 Hiraoka
4,631,012 A 12/1986 Eckman
4,839,995 A 6/1989 Hutchins
5,020,607 A 6/1991 Sentivan
5,110,030 A 5/1992 Tanji
5,131,579 A 7/1992 Okushima et al.
5,199,505 A 4/1993 Izumisawa
D339,726 S 9/1993 Bruno et al.
5,292,352 A 3/1994 Rudolf et al.
5,293,747 A 3/1994 Geiger
5,330,106 A 7/1994 Braun, Jr.
5,346,024 A 9/1994 Geiger et al.
5,377,769 A 1/1995 Hasuo et al.
5,383,771 A 1/1995 Ghode et al.
5,417,294 A 5/1995 Suher
5,441,450 A 8/1995 Fein et al.
5,535,646 A 7/1996 Allen et al.
5,535,867 A 7/1996 Coccaro et al.
5,591,070 A 1/1997 Kachich
5,784,934 A 7/1998 Izumisawa
D408,243 S 4/1999 Izumisawa
5,901,794 A 5/1999 Schoeps et al.
5,906,244 A 5/1999 Thompson et al.
5,918,686 A 7/1999 Izumisawa
5,992,539 A 11/1999 Lin
5,992,540 A 11/1999 Smolinski et al.
6,082,468 A 7/2000 Pusateri et al.
6,443,239 B1 * 9/2002 Izumisawa ..... 173/169

* cited by examiner

PNEUMATIC ROTARY TOOL

BACKGROUND OF THE INVENTION

This invention generally relates to pneumatic rotary tools and more particularly to an improved pneumatic rotary tool having a plastic housing and a variable torque design for efficient use of pressurized air.

The invention is especially concerned with a powered tool that rotates an output shaft with a socket for turning a fastener element such as a bolt or nut. Tools of this type are frequently used in automotive repair and industrial applications. Conventionally, pneumatic rotary tools comprise a metallic outer housing with multiple metallic internal parts. These tools are strong and durable due to their metallic construction, although the all-metal construction makes them both somewhat heavy and costly. Pressurized air flowing through the tool powers tools of this type. As the air expands within the tool, it induces motion of an internal motor, powering the tool.

It is an aim of tool manufacturers to provide a pneumatic rotary tool that is as durable as an all-metal tool, but employs portions formed from lighter materials, such as plastic, where appropriate to reduce the weight and cost of the tool. One difficulty in the design of such a tool is the reduced rigidity of plastic as compared with a strong metal, such as steel. For instance, should a plastic tool fall against a hard surface, a metallic air motor inside the tool may shift and become misaligned, or canted, with respect to the housing and the output shaft, rendering the tool unusable. This problem has led tool manufacturers to create complex internal motor casings designed to inhibit the motor from canting in the housing. For example, U.S. Pat. No. 5,346,024 (Geiger et al.) discloses such a motor casing, described as a motor cylinder 15. This casing is cylindrical in shape, with one closed end that includes multiple parts, such as a back head 26 and bore 27, extending from the closed end. The cylinder, back head and bore are of unitary construction, making a closed end cylinder significantly more difficult to manufacture. Therefore, these casings are expensive to manufacture, which may mitigate the cost benefit of using lighter and less costly materials, such as plastic, for other parts. As such, a tool formed inexpensively from both lightweight material and metallic parts is desirable.

In addition, conventional rotary tools often incorporate mechanisms to regulate torque according to user input. One such tool uses back pressure within the air motor to regulate the torque output. As backpressure within the motor increases, the torque output of the motor decreases. Such a design is inefficient because it uses the maximum flow of pressurized air to power the tool, while operating below its maximum power. At lower torque settings, a large portion of air bypasses the motor for backpressuring the motor, adding no power to the tool. As such, a tool that can more efficiently regulate torque by using less pressurized air is needed. Moreover, a tool that can reduce backpressure in the motor will operate more efficiently, using less air for the same work.

Typically air motors incorporate a rotor having a plurality of vanes upon which the pressurized air can react, inducing rotation of the rotor. Pockets of pressurized air are received within compartments defined by adjacent vanes. Conventional rotary tools typically have a single exhaust port in the air motor for exhausting pressurized air from the motor. As each rotor compartment passes the exhaust port, much of the air within the compartment passes through the exhaust port and exits the motor. Any air remaining within the compartment after the compartment passes the exhaust port becomes trapped within the compartment. The volume of the compartment decreases as the compartment nears completion of a motor cycle, and the compartment must compress the air within the compartment for the rotor to continue to rotate. Compressing the air within the compartment (backpressure) reduces the rotational speed of the turning rotor. Backpressure reduces motor efficiency; thus, a pneumatic rotary tool that reduces backpressure losses within the air motor is desirable.

SUMMARY OF THE INVENTION

Among the several objects and features of the present invention may be noted the provision of a pneumatic rotary tool which weighs and costs less due to a primarily plastic housing; the provision of such a tool having a plastic housing which resists misalignment of internal components under impact; the provision of such a tool which is comfortable to grip; the provision of such a tool having a plastic housing which fixes components without fasteners; the provision of such a pneumatic rotary tool which regulates torque between four discrete levels adjustable by the user; the provision of such a pneumatic rotary tool which throttles pressurized air as it enters the tool to efficiently control torque output of the motor by reducing how much air enters the tool; and the provision such of a pneumatic rotary tool which reduces back pressure within the motor and increases motor efficiency.

Generally, a pneumatic rotary tool of the present invention comprises a housing formed substantially from plastic and an air motor disposed within the housing. The tool further comprises a first rigid support of a material more rigid that the plastic housing for engaging the air motor and the housing generally at one end of the motor. A second rigid support of a material more rigid that the plastic housing engages the air motor and the housing generally at an opposite end of the motor. The first and second rigid supports support the air motor from movement and misalignment within the housing.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
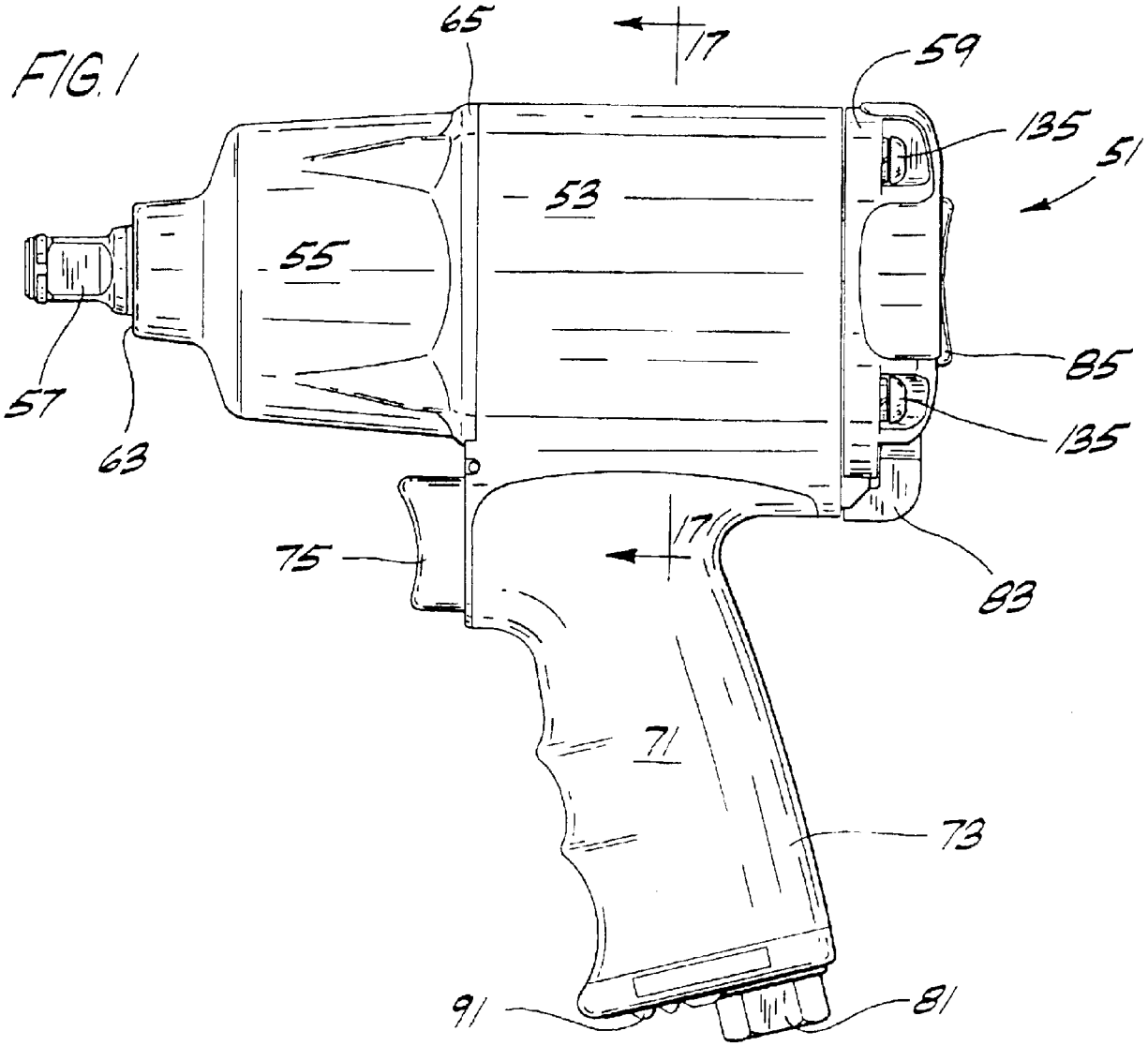
FIG. 1 is a side elevation of a pneumatic rotary tool of the present invention.
Figure 29:
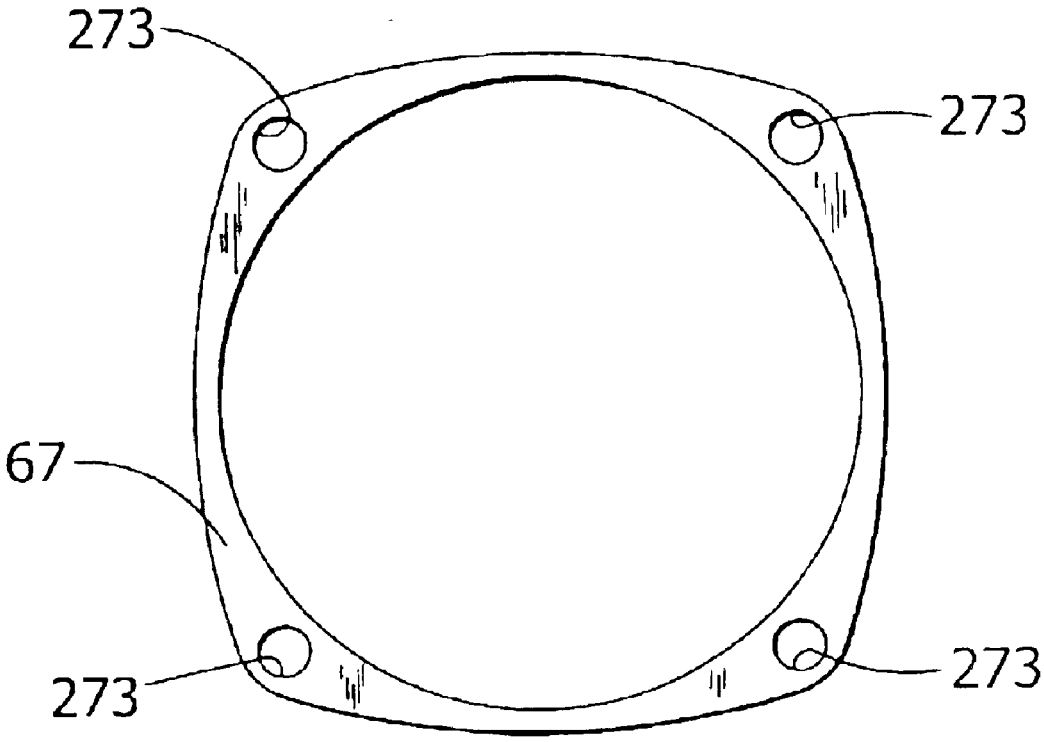
FIG. 29 is a rear elevation of a gasket of the tool.

Referring now to the drawings and specifically to FIG. 1, a pneumatic rotary tool of the present invention is generally indicated at 51. The tool includes a housing 53, a Maurer Mechanism casing 55 (broadly, a first rigid support) at the front of the housing, an output shaft 57 and an end cover 59 mounted on the rear of the housing 53. The casing 55 may be considered part of the housing 53, due to the generally uniform interface between the housing and casing, which creates the appearance of one continuous profile when viewing the tool 51. The output shaft 57 extends from an front end 63 of the Maurer Mechanism casing 55. A back end 65 of the Maurer Mechanism casing 55 engages the housing 53. A gasket 67 (FIGS. 3 and 29) seals the interface between the back end 65 of the Maurer Mechanism casing 55 and the housing 53 to keep lubricating fluids within the tool 51. The gasket 67 is preferably formed from a fibrous material, such as paper, but may also be formed from rubber, cork, plastic or other any other suitable material. The tool 51 further comprises a grip 71 extending downwardly from the housing 53, allowing a user to grasp and hold the tool securely. The grip 71 has an additional outer layer 73 of soft material, such as rubber, to cushion and ease pressure on the user's hand, while increasing friction between the grip 71 and the user, making the tool 51 easier to hold. A trigger 75 extends from the front of the grip 71 for activating the tool 51. Furthermore, the tool 51 comprises an air inlet 81 for supplying pressurized air to the tool. The air inlet 81 mounts on the lower portion of the grip 71 and receives an air hose (not shown), as is conventional in the industry.

Figure 2:
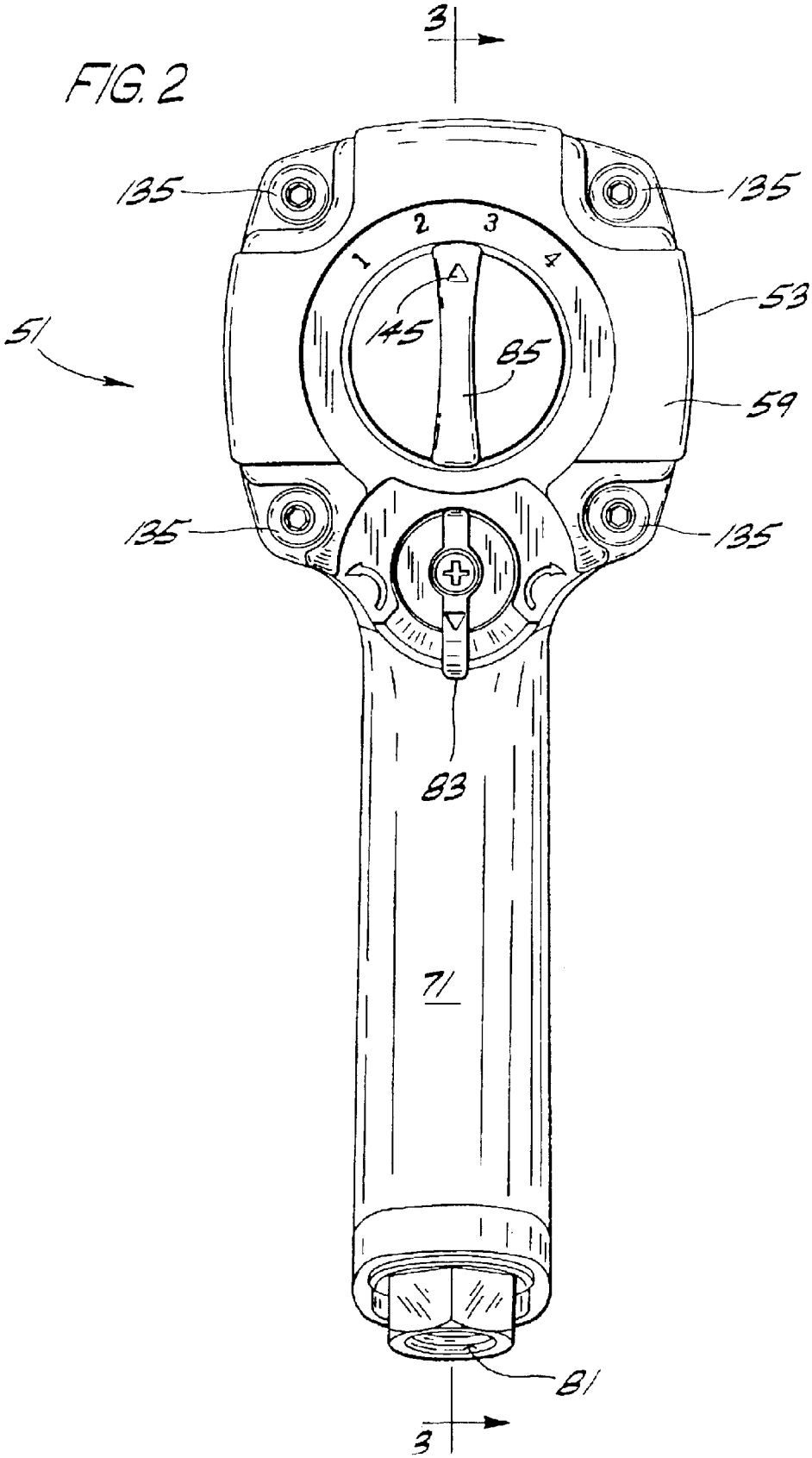
FIG. 2 is a rear elevation of the tool of FIG. 1.

Referring now to FIG. 2, the tool 51 additionally includes a rotation selector valve 83 mounted on the rear of the housing 53 for selecting the rotational direction of the output shaft 57. The rotation selector valve 83 is rotatable within the housing 53 and end cover 59 for altering a flow of compressed air within the tool 51 to control the direction of output shaft 57 rotation. A torque selector 85 mounted on the end cover 59 is rotatable within the end cover for controlling the torque of the tool 51 by throttling the flow of compressed air. In the illustrated embodiment, the torque selector 85 has four discrete positions corresponding to four torque settings. The functioning of the rotation selector valve 83 and the torque selector 85 will be discussed in greater detail below.

Figure 3:
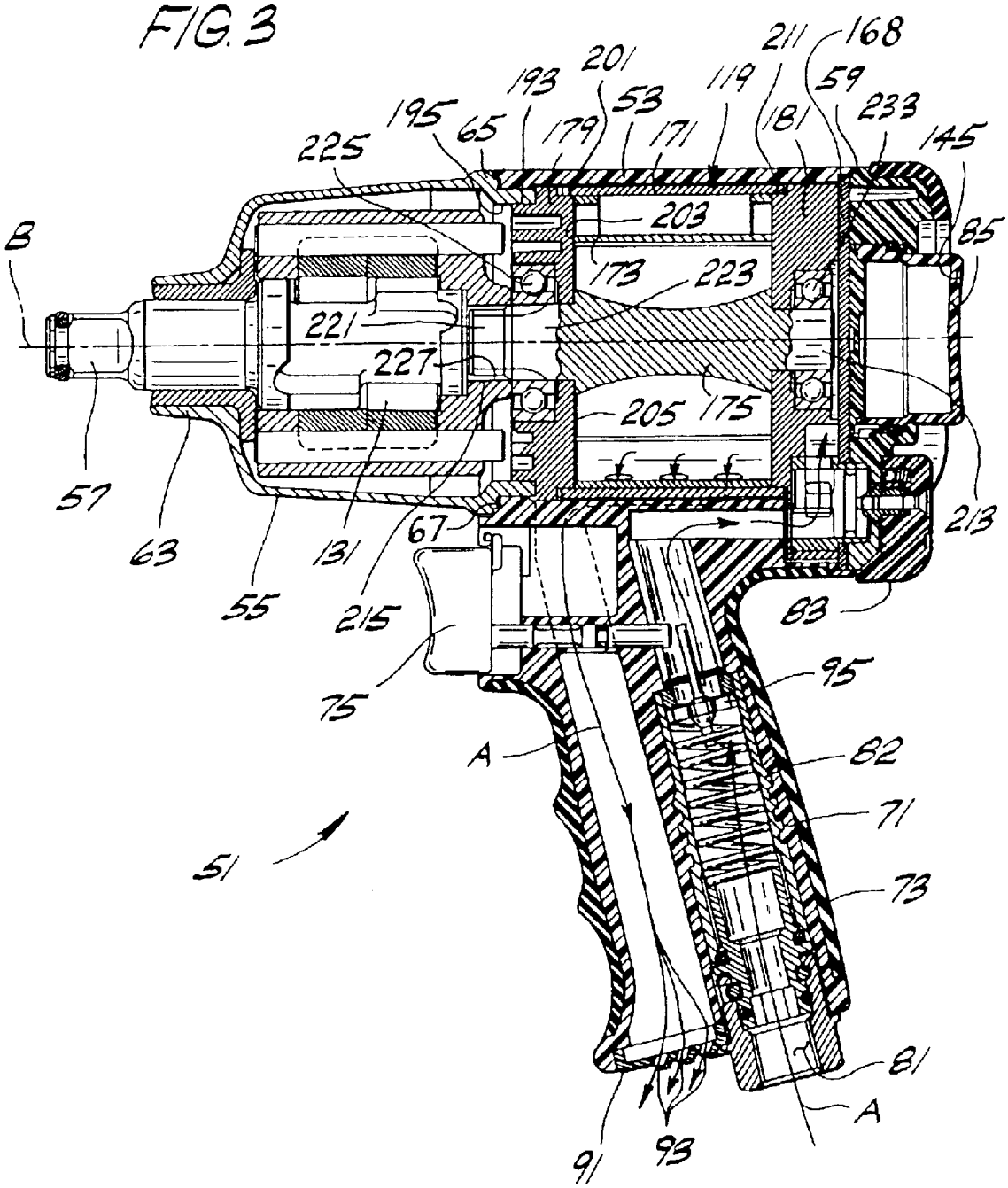
FIG. 3 is a section of the tool taken in a plane including line 3—3 of FIG. 2.
Figure 3A:
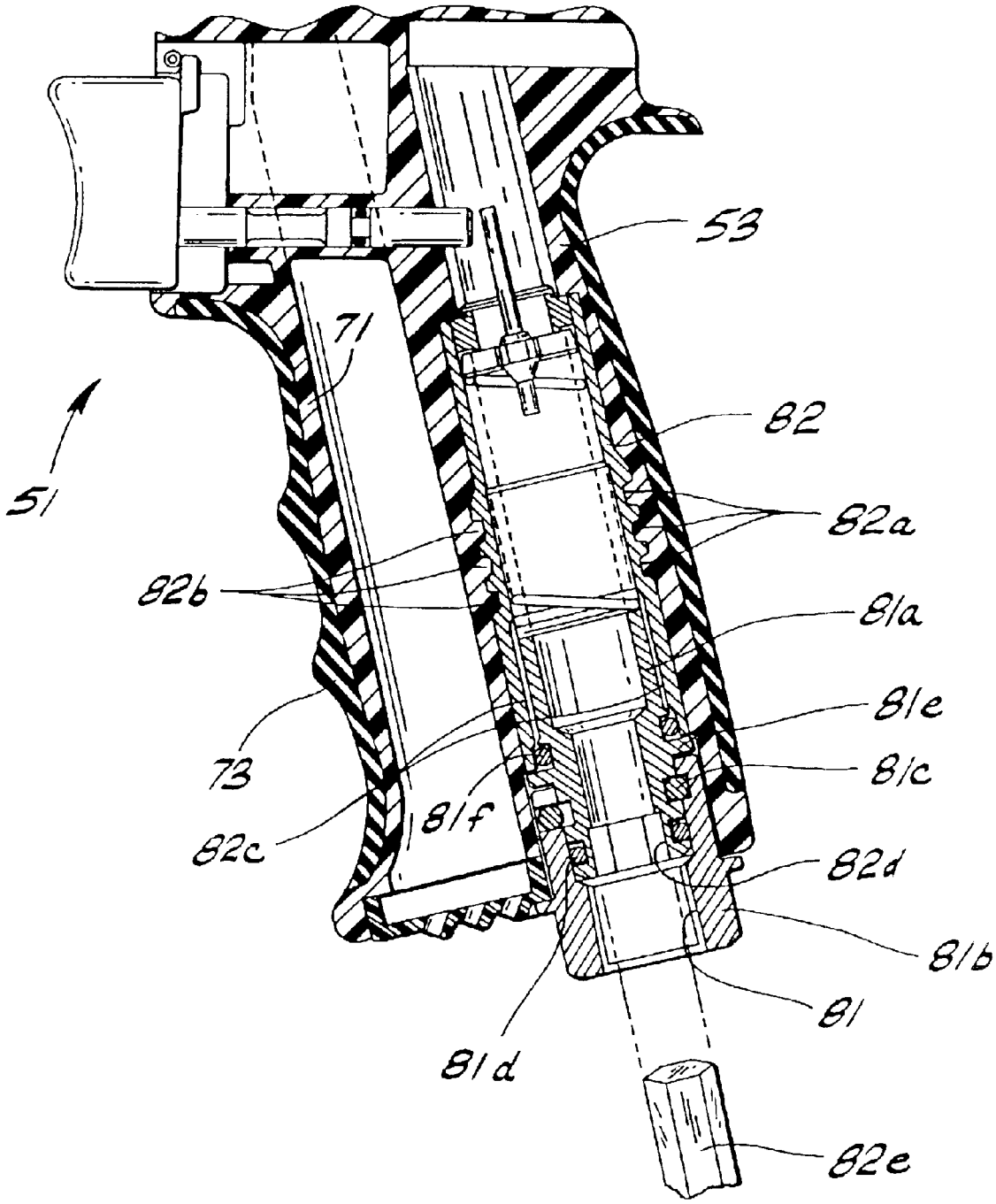
FIG. 3A is an enlarged, fragmentary section of the tool of FIG. 3 showing the grip.

Additionally, an air exhaust 91 mounts on the lower portion of the grip 71, adjacent the air inlet 81 (FIG. 3). The air exhaust 91 includes a plurality of small holes 93 for diffusing exhaust air as it exits the tool 51, directing exhaust air away from the user and preventing foreign objects from entering the air exhaust.

Figure 3C:
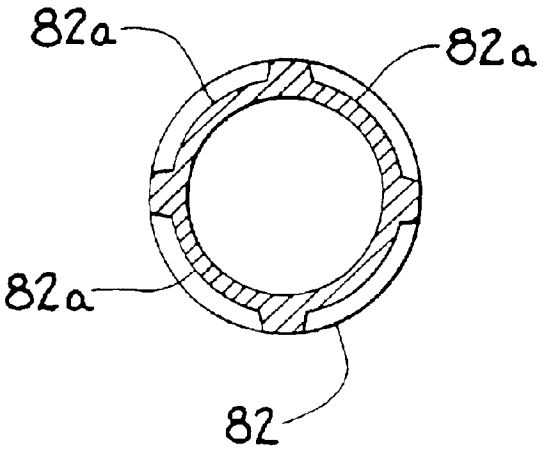
FIG. 3C is a section of the inlet cylinder taken in a plane including line 3C—3C of FIG. 3B.
Figure 3B:
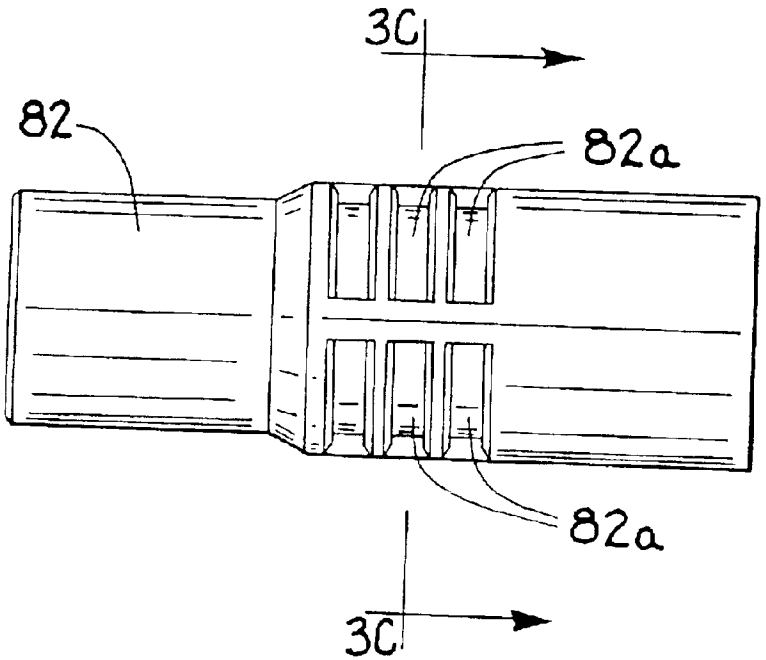
FIG. 3B is a side elevation of an inlet cylinder.

Turning to the interior workings of the tool 51, FIG. 3 discloses a side section of the tool. Air flow through the tool 51 is generally indicated by line A. Following the path of line A, pressurized air first enters the tool 51 through the air inlet 81. The air inlet 81 comprises a fitting 81*a*, a swivel connector 81*b* and an air inlet cylinder 82 through which air passes (FIGS. 3-3C). The plastic housing 53 is formed by a molding process in which plastic in a flowable form surrounds and engages the exterior of the inlet cylinder 82. The inlet cylinder includes annular grooves 82*a* into which the plastic flows when the housing 53 is formed. When the plastic hardens, the material in the grooves 82*a* forms protrusions 82*b* engaging the air inlet cylinder 82 in the grooves to secure the air inlet 81 in the housing. The housing 53 sufficiently encases the inlet cylinder 82 so that no fastening devices are necessary for holding the inlet cylinder within the housing. The preferred molding process for forming the housing 53 around the air inlet cylinder 82 is a plastic injection molding process that is well known in the relevant art and described in further detail below.

The fitting 81*a* mounts the swivel connector 81*b* for pivoting of the swivel connector about the axis of the air inlet 81 via a snap ring 81*c*. Other mounting methods other that a snap ring 81*c*, such as a ball and detent, are also contemplated as within the scope of the present invention. An O-ring 81*d* seals between the fitting 81*c* and the swivel connector 81*b* to inhibit pressurized air entering the air inlet from escaping. The snap ring 81*c* and O-ring 81*d* do not inhibit the rotation of the swivel connector 81*b* on the fitting 81*a*. An upper end of the fitting 81*a* is threaded, as is the lower internal end of the air cylinder 82. The fitting 81*a* is threaded into the lower end of the inlet cylinder 82 until a flange 81*e* of the fitting abuts the lower end of the inlet cylinder. Another O-ring 81*f* seals between the fitting 81*a* and the inlet cylinder 82 so that air flows through the inlet cylinder to the working parts of the tool. A hex-shaped keyway 82*d* is designed to receive a hex-shaped key (a fragment of which is indicated at 82*e*) for rotating the fitting

81*a* within respect to the air inlet cylinder 82, thereby engaging the threads 82*c* and threading the fitting fully into the cylinder. The keyway 82*d* and key 82*e* may be formed in any number of matching shapes (e.g., star, square, pentagon, etc.) capable of transferring force from the key to the fitting 81*a*.

Moreover, the outer layer 73 of soft material, preferably formed from rubber, is overmolded onto the grip 71 after the plastic molding process. The preferred overmolding process forms the outer layer 73 directly on the grip 71, fusing the outer layer to the surface of the grip and providing a more secure gripping surface for the user. The overmolding process essentially requires the use of a mold slightly larger than the grip 71, such that the space between the grip and the mold can receive flowable rubber material, which forms the outer layer 73 of the grip, after the rubber cures. Because the rubber outer layer 73 fuses directly to the grip 71, the layer fits snugly over the grip and requires no further retention means. The snug fit helps the outer layer 73 stay seated against the grip 71 during tool 51 use, so that the user can firmly grip the tool without movement between the grip and the outer layer.

Figure 4:
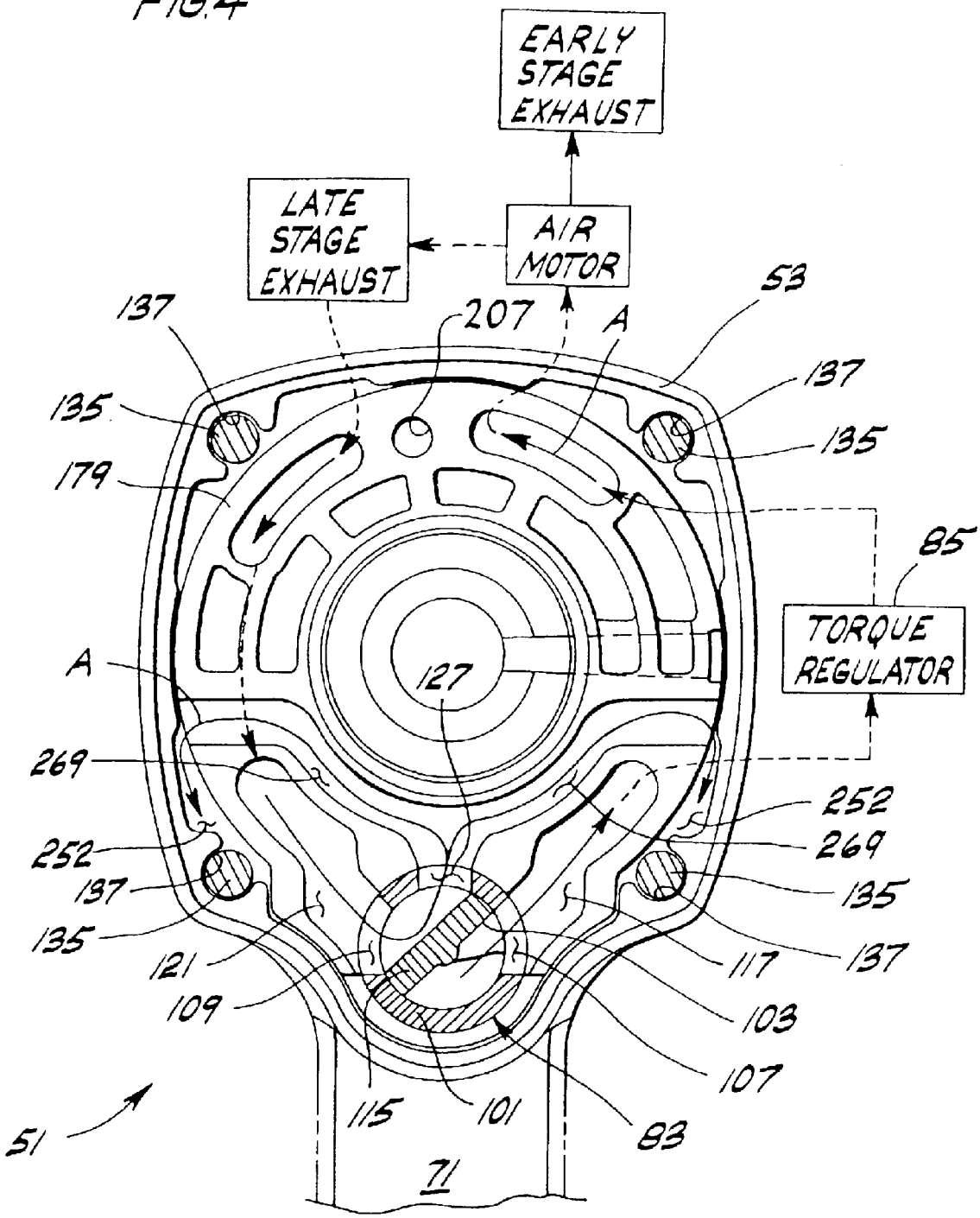
FIG. 4 is a fragmentary schematic rear elevation with an end cover of the tool removed to reveal internal construction and air flow.
Figure 6:
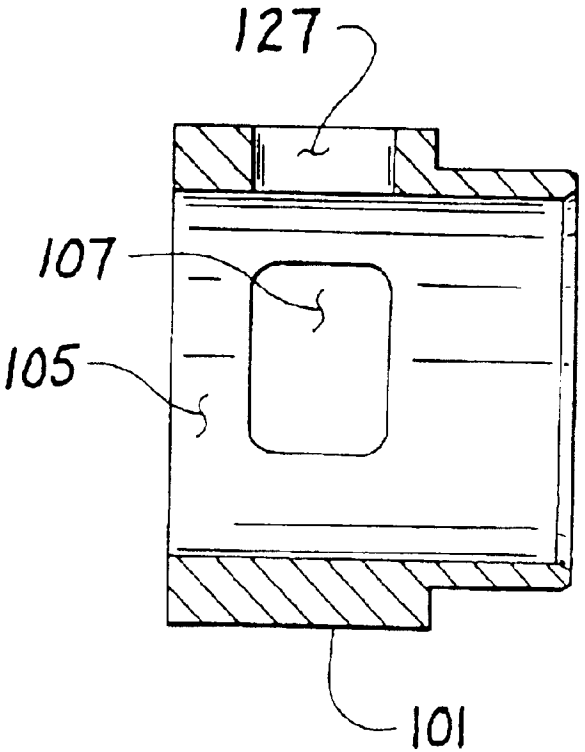
FIG. 6 is a section of the valve body taken in a plane including line 6—6 of FIG. 5.
Figure 5:
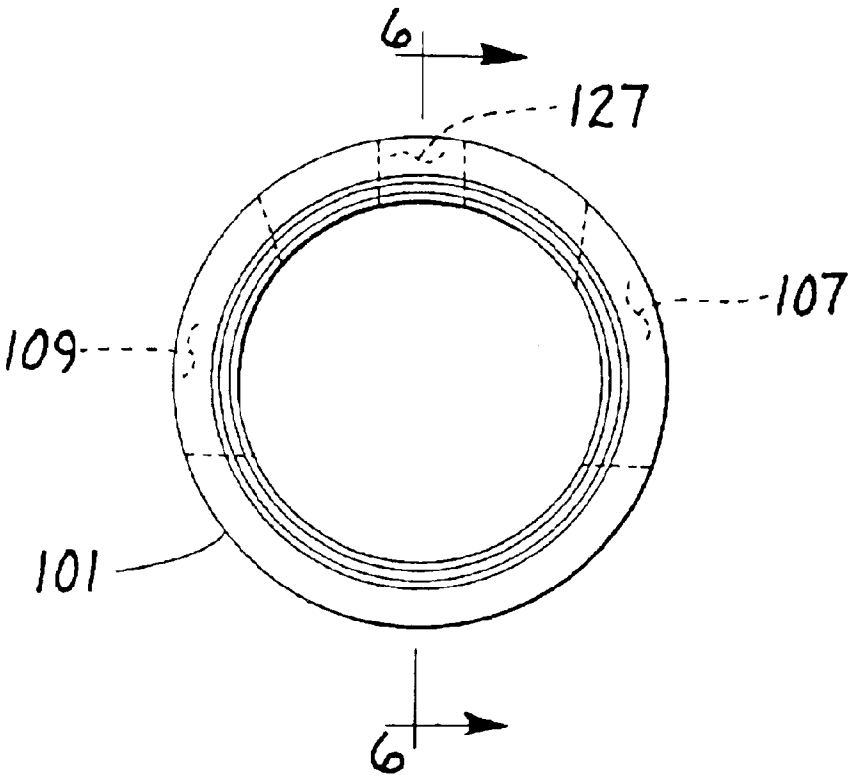
FIG. 5 is a rear elevation of a valve body.
Figure 8:
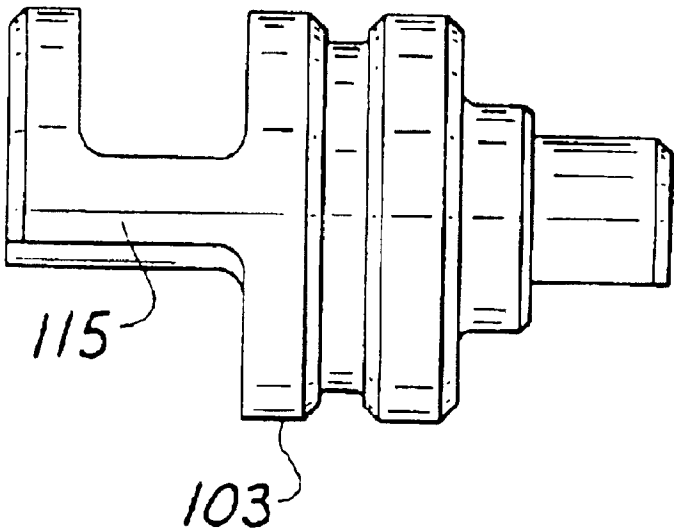
FIG. 8 is a right side elevation of the valve member of FIG. 7.
Figure 7:
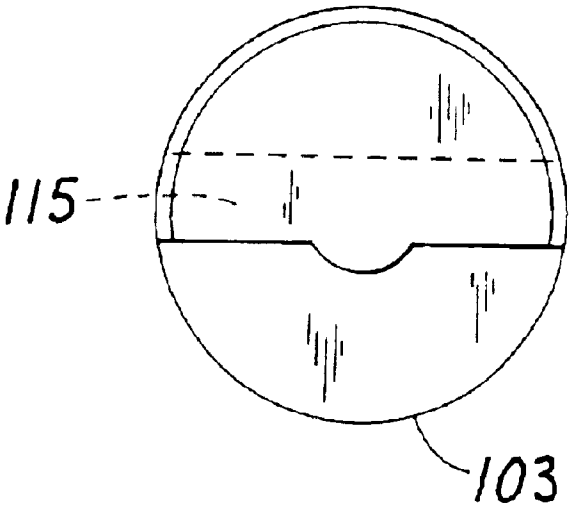
FIG. 7 is a front elevation of a valve member.

After the inlet 81, the air passes through a tilt valve 95, which can be opened by pulling the trigger 75 (FIG. 3). The detailed construction and operation of the tilt valve 95 will not be discussed here, as the design is well known in the relevant art. The air then passes through the remainder of the inlet 81 until it passes through the rotation selector valve 83 (FIGS. 3 and 4). The rotation selector valve 83 comprises two pieces, a valve body 101 (FIGS. 4, 5 and 6) fixed in position and a valve member 103 (FIGS. 7 and 8) rotatable within the valve body. The valve body 101 is cylindrical having a first open end 105 for allowing air to enter the rotation selector valve 83. The valve member 103 directs the flow of air through the valve body 101 and out through either a first side port 107 or a second side port 109. The valve member 103 has an interior plate 115 rotatable with the valve member for directing the pressurized air. Referring now to FIG. 4, when in a first position, the plate 115 directs air through the first side port 107 and into a first passage 117 for delivering air to an air motor, generally indicated at 119 (FIG. 17) (discussed below), to power the motor and drive the output shaft 57 in the forward direction. When in a second position (shown in phantom in FIG. 4), the plate 115 directs air through the second side port 109 and into a second passage 121 for delivering air to the motor 119 to power the motor and drive the output shaft 57 in the reverse direction. The valve body 101 contains an additional top port 127 which allows a secondary air flow through the valve 83 simultaneous with air flow directed through either the first or second passage 117,121. The details of the secondary air flow will be discussed below.

The pneumatic rotary tool 51 is of the variety of rotary tools known as an impact wrench. A Maurer Mechanism 131 (FIG. 3), contained within the Maurer Mechanism casing 55 and discussed below, converts high speed rotational energy of the air motor 119 into discrete, high torque moments on the output shaft 57. Because the high torque impacts are limited in duration, an operator can hold the tool 51 while imparting a larger moment on the output shaft 57 than would be possible were the high torque continually applied. Impact tools are useful for high torque applications, such as tightening or loosening a fastener requiring a high torque setting.

Once the air passes through the rotation selector valve 83, the air travels through an air passage toward the air motor 119. The air passage may be configured with different passages as will now be described in greater detail. First, air passes through either the first or second passage 117,121 on its way to the air motor 119. Air directed through the first passage 117 passes through a torque selector 85 (FIG. 4). As discussed previously, the torque selector 85 controls the pressurized air, allowing the user to set a precise output torque for the tool 51. The end cover 59 mounts on the rear of the housing 53 (FIG. 3). Four bolt holes 133 formed in the end cover 59 receive threaded bolts 135 for attaching the end cover 59 and the Maurer Mechanism casing 55 to the housing 53 (FIGS. 3 and 10). The bolts 135 fit through the holes 133 in the end cover 59, pass through elongate bolt channels 137 formed within the housing 53 and fit into threaded holes (not shown) within the Maurer Mechanism casing 55, clamping the tool components together (FIGS. 2, 4 and 9).

Figure 9:
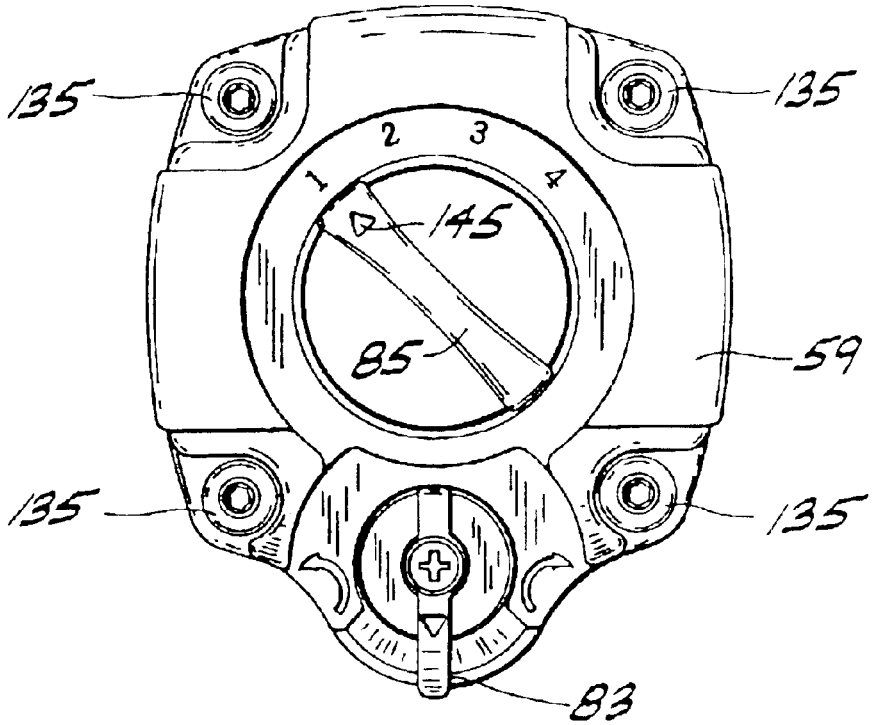
FIG. 9 is a rear elevation of the end cover with a torque selector positioned to a setting of 1.
Figure 10:
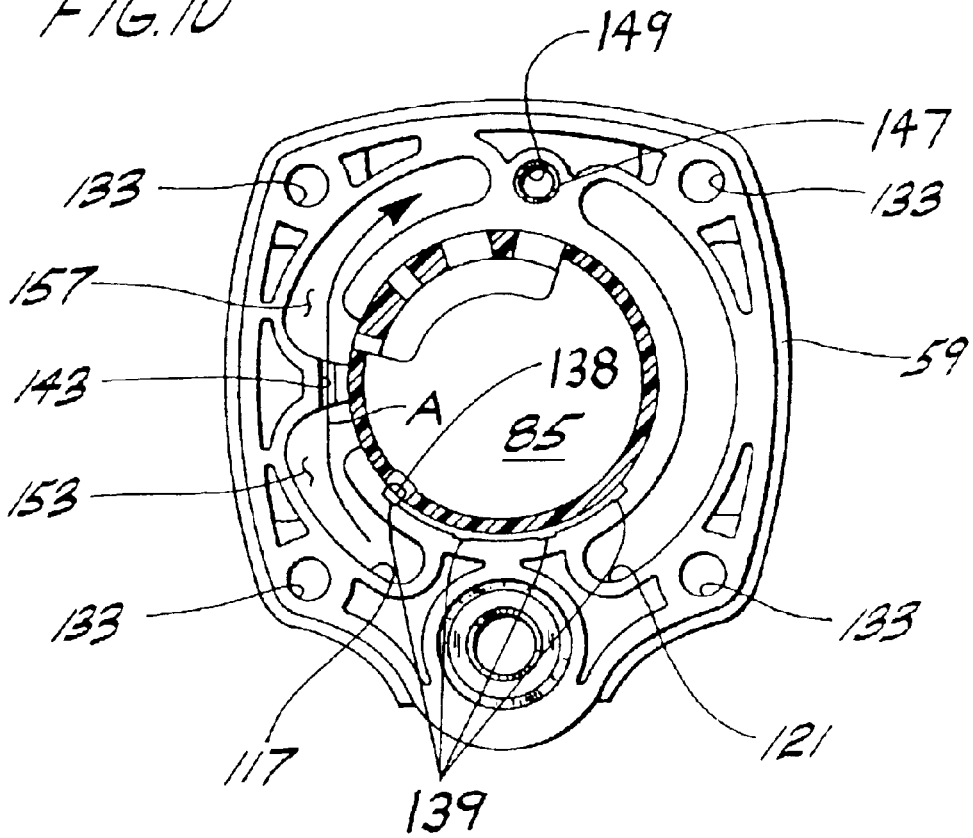
FIG. 10 is a front elevation of the end cover and partial section of the torque selector of FIG. 9.

Referring to FIGS. 9–15, the torque selector 85 rotates within the end cover 59 between four discrete settings. As the selector 85 rotates to each setting, a small protuberance 138 engages one of four notches 139 within the end cover 59. The protuberance 138 is resiliently formed to extend outward from the selector 85 to engage each notch 139 as the selector rotates. The movement of the protuberance 138 and the increase in force required to move the protuberance from the notch 139 indicates to the user that the selector 85 is positioned for one of the discrete settings. FIGS. 9 and 10 show the first setting, where the flow of air through the first passage 117 is limited to air passing through a fixed orifice 143. The fixed orifice 143 has a smaller cross-sectional area than the first passage 117, throttling the air passing through the first passage. The torque selector 85 blocks any additional air from passing through the first passage 117. The first setting corresponds to the lowest torque output, because the first passage 117 allows a minimum amount of air to pass. Viewing the torque selector 85 from the rear, an arrow indicator 145 on the torque selector indicates a setting of 1.

The end cover 59 additionally includes an orientation socket 147 for receiving an orientation pin 149 (FIG. 10). The orientation pin extends from the end cover 59 for receiving and orienting tool components with respect to one another. Because of the orientation pin 149, tool components align and orient properly with respect to one another, ensuring that the tool is assembled and functions properly. Components receiving the orientation pin 149 will be discussed in greater detail below.

Figure 11:
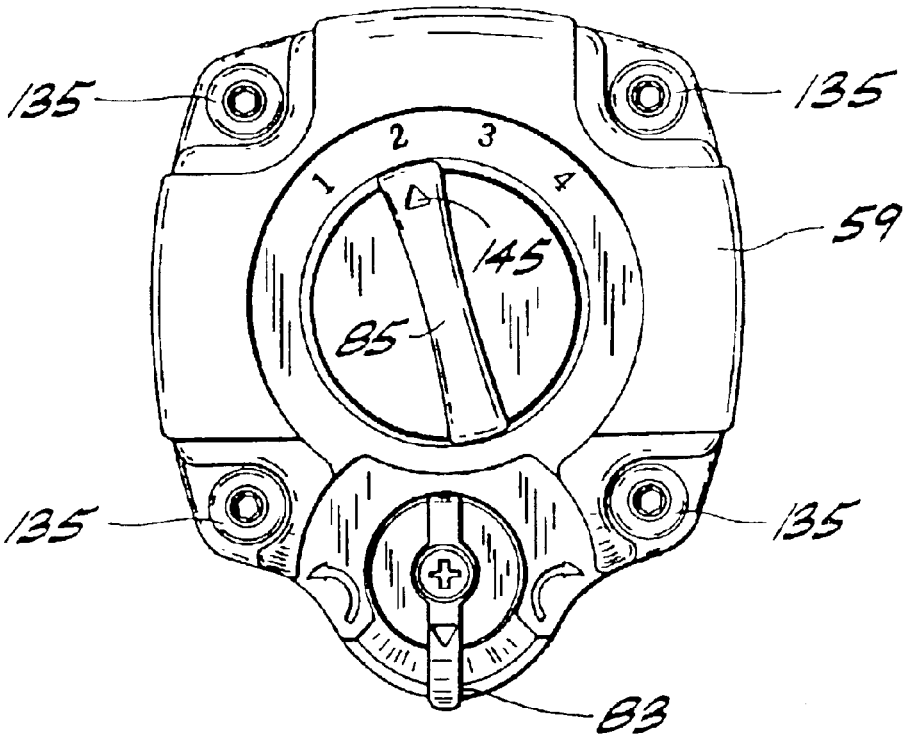
FIG. 11 is a rear elevation of the end cover with the torque selector positioned to a setting of 2.
Figure 12:
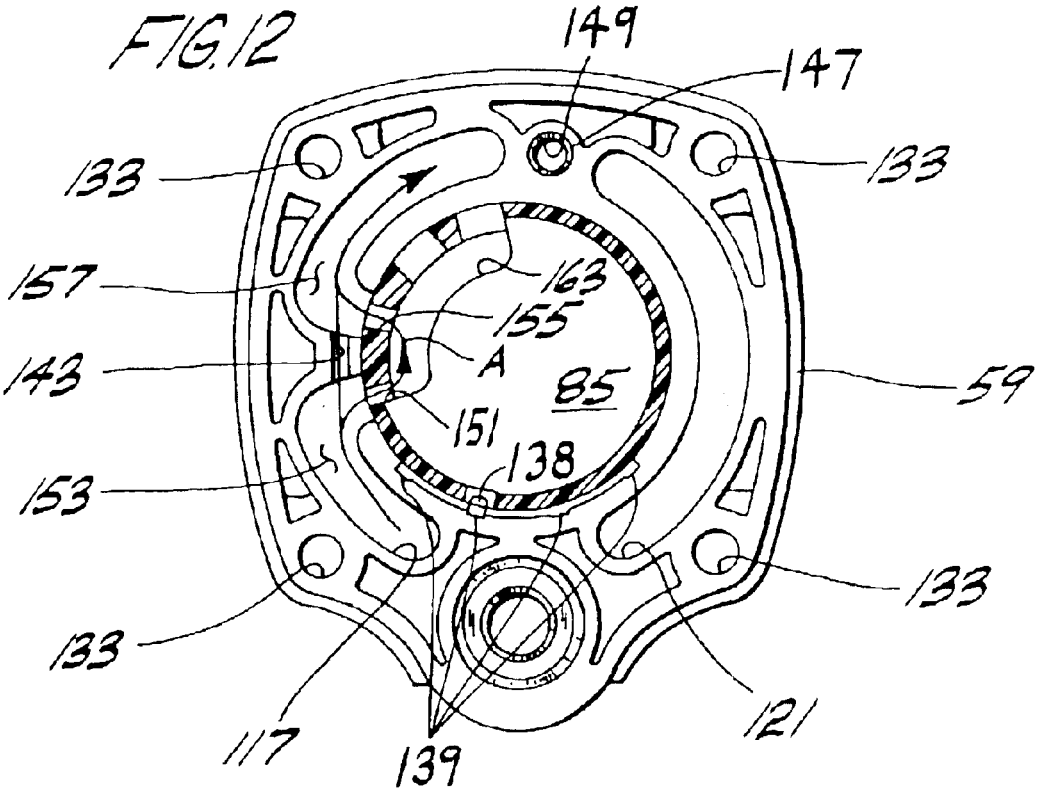
FIG. 12 is a front elevation of the end cover and partial section of the torque selector of FIG. 11.

Turning to FIGS. 11 and 12, the arrow indicator 145 indicates a setting of 2, where a first port 151 of the torque selector 85 is aligned with a lower portion 153 of the first passage 117 and a second, larger port 155 of the torque selector is aligned with an upper portion 157 of the first passage. In this configuration, some air bypasses the fixed orifice 143 and passes to the upper portion 157 of the first passage 117. More specifically, this air passes through the lower portion 153 of the first passage 117, the first port 151, a selector passage 163, the second port 155 and finally into the upper portion 157 of the first passage. At the same time, air continues to pass through the fixed orifice 143, as with the first setting. Thus, the total amount of air passing through the first passage 117 to the air motor 119 is the sum of the air passing through the torque selector 85 and the fixed orifice 143. Like the fixed orifice 143, the first port 151 controls how much air moves through the first passage 117, throttling tool power.

Figure 13:
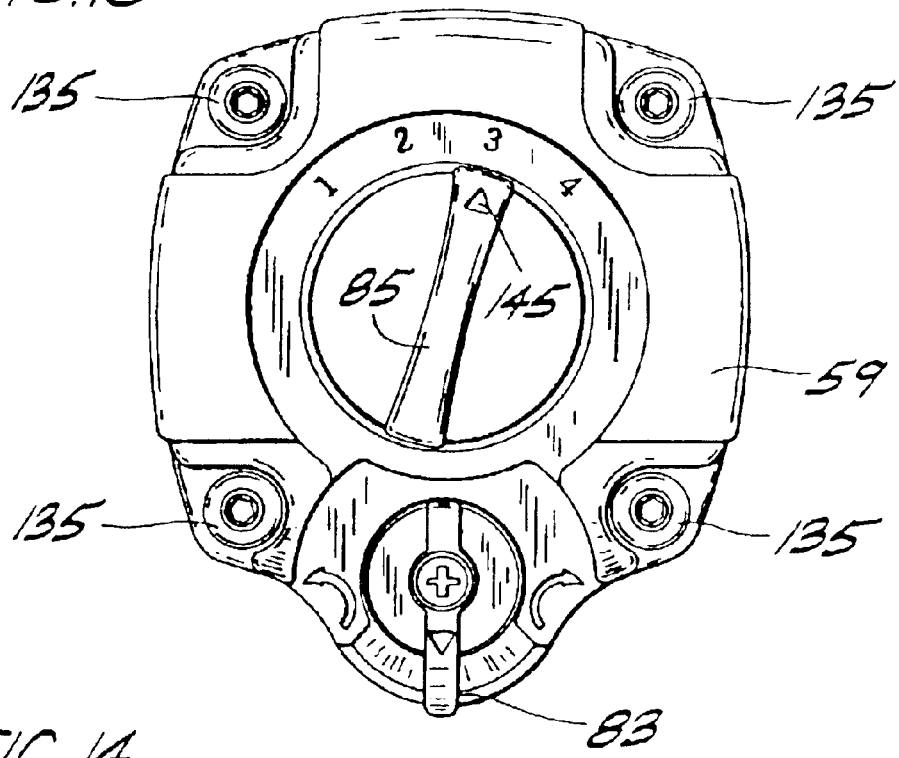
FIG. 13 is a rear elevation of the end cover with the torque selector positioned to a setting of 3.
Figure 14:
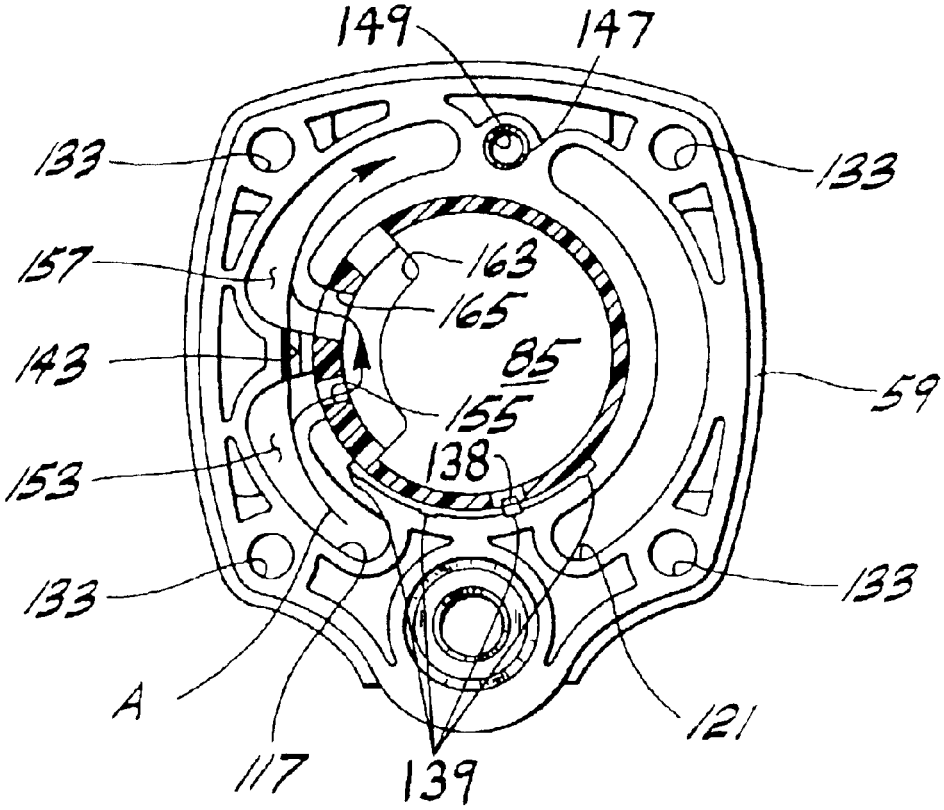
FIG. 14 is a front elevation of the end cover and partial section of the torque selector of FIG. 13.
Figure 15:
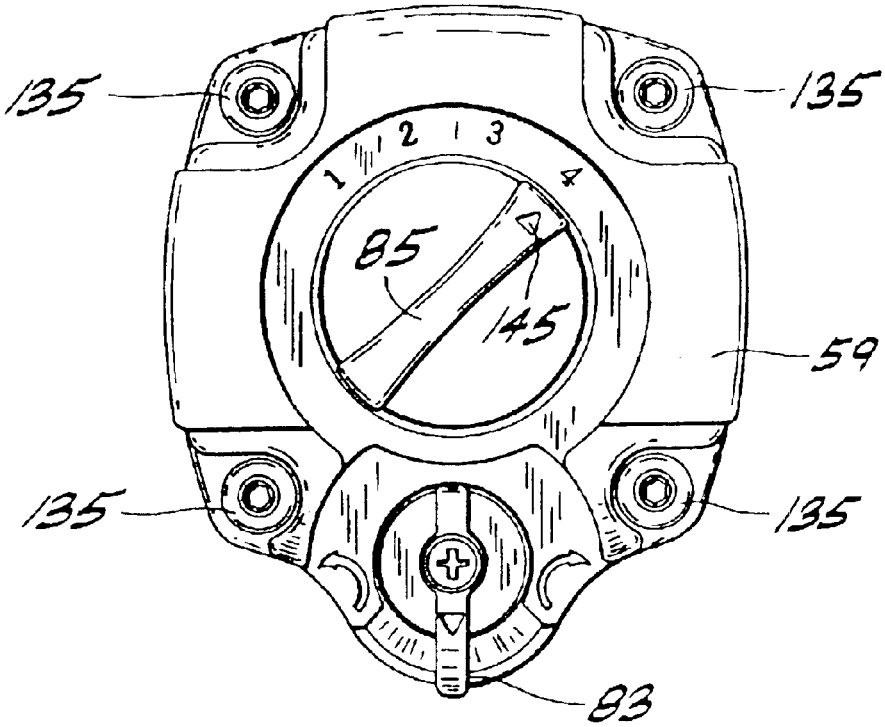
FIG. 15 is a rear elevation of the end cover with the torque selector positioned to a setting of 4.

Referring to FIGS. 13 and 14, the arrow indicator 145 indicates a setting of 3, where the second port 155 of the torque selector 85 is aligned with a lower portion 153 of the first passage 117 and a third, larger port 165 of the torque selector 85 is aligned with an upper portion 157 of the first passage. Again, the total amount of air passing through the first passage 117 is the sum of the air passing through the torque selector 85 and the fixed orifice 143. Using this selection, the sizes of the second port 155 and the fixed orifice 143 control how much air moves through the first passage 117, throttling tool power.

Figure 16:
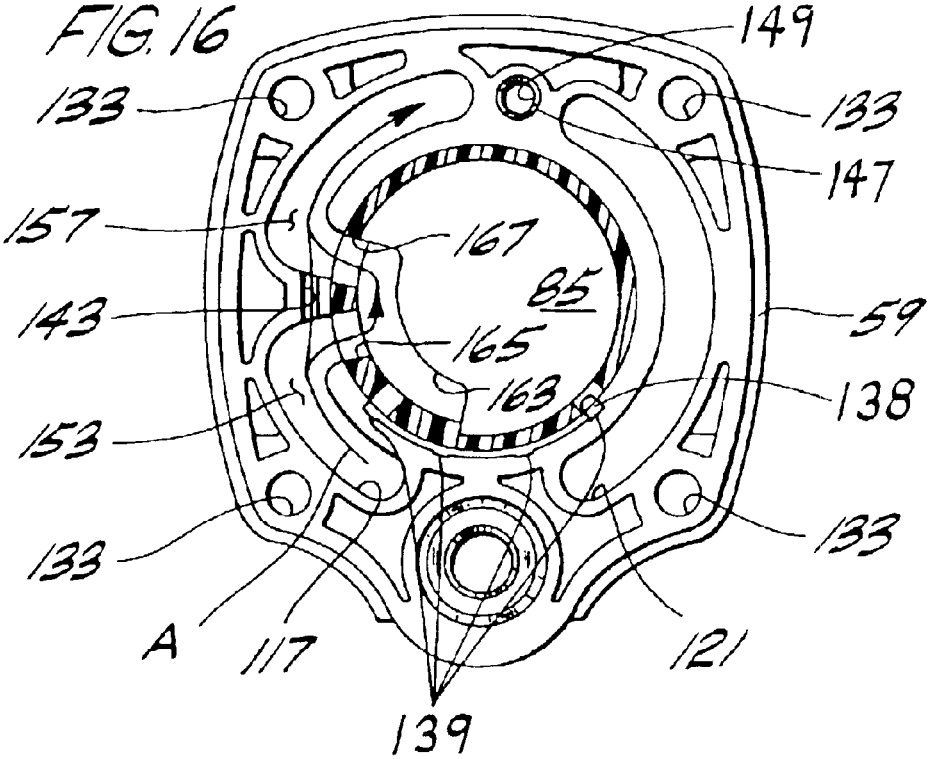
FIG. 16 is a front elevation of the end cover and partial section of the torque selector of FIG. 15.

In the final position (FIGS. 15 and 16), the arrow indicator 145 indicates a setting of 4, where the third port 165 of the torque selector 85 is aligned with a lower portion 153 of the first passage 117 and a fourth port 167 of the torque selector, identical in size to the third port, is aligned with an upper portion 157 of the first passage. The total amount of air passing through the first passage 117 is the sum of the air passing through the torque selector 85 and the fixed orifice 143. Using this selection, the size of the third port 165 and the fixed orifice 143 control how much air moves through the first passage 117, controlling tool power at a maximum allowable torque in the forward rotational direction. It is contemplated that the torque selector 85 could be formed with a fewer or greater number of ports without departing from the scope of the present invention.

Figure 16A:
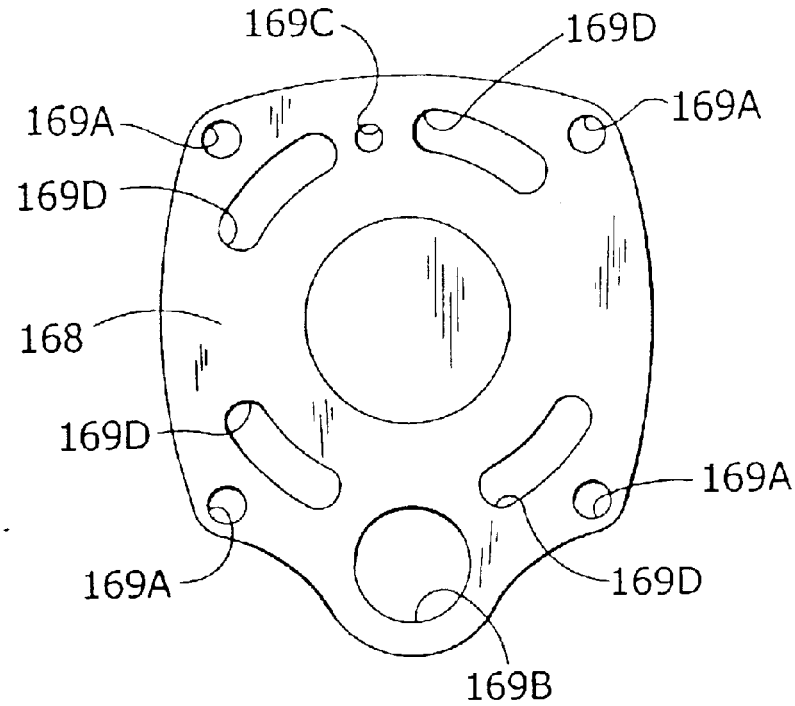
FIG. 16A is a rear elevation of a support plate of the tool.
Figure 16B:
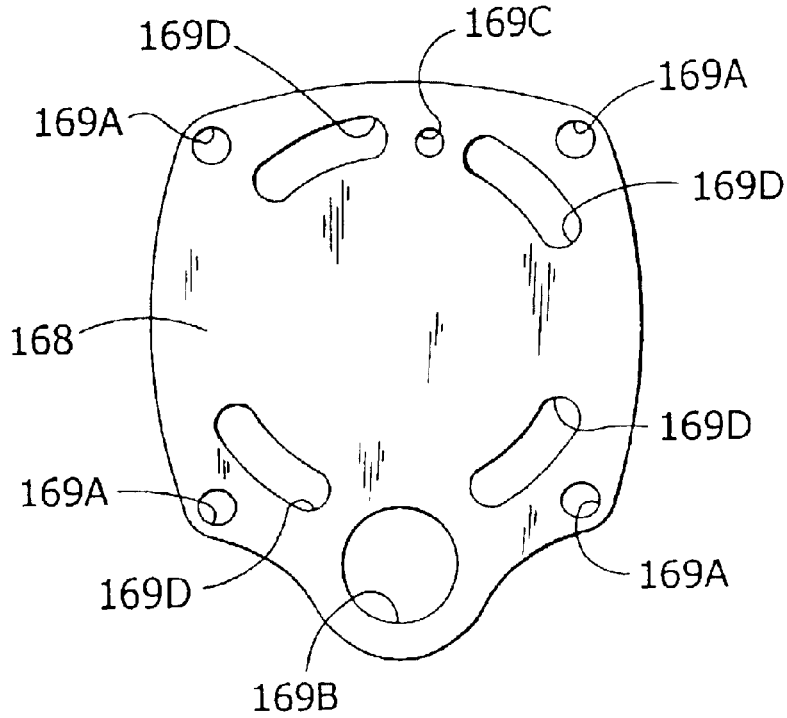
FIG. 16B is a front elevation of the support plate of FIG. 16A.

Once the pressurized air passes through the first passage 117 and torque selector 85, it passes through a support plate 168 (broadly, a second rigid support) before entering the air motor 119 (FIGS. 3, 16A and 16B). The support plate 168 includes multiple openings 169 for receiving various tool components. Bolt openings 169A are arranged at the four corners of the support plate for receiving bolts 135. A rotation selector valve opening 169B allows the rotation selector valve 83 to pass through the support plate 168. An orientation opening 169C passes through the support plate 168 for receiving the orientation pin 149 extending from the orientation socket 147 of the end cover 59. With the bolts 135, rotation selector valve 83 and orientation pin 149 passing through the support plate 168, the end cover 59 and support plate are located in the proper position. Insertion of the orientation pin 149 ensures that the tool components assemble together properly by permitting the components to arrange in a single, correct configuration. Further, air passage openings 169D are arranged within the support plate 168 to mate with the first or second passages 117,121 to allow movement of air from the torque selector 85 to the air motor 119, as will be discussed in greater detail below. The support plate 168 further includes an outer layer of rubber material 170 on both plate faces for sealing engagement with the end cover 59 and the air motor 119. When fully assembled, as discussed in greater detail below, the support plate 168 supports the plastic end cover 59 to inhibit it from bending and encouraging uniform support of the motor 119 during tool 51 use. The support plate 168 is preferably formed from steel, although other metallic and non-metallic materials exhibiting strength characteristics adequate to support the plastic end cover 59 are also contemplated as within the scope of the present invention.

Figure 17:
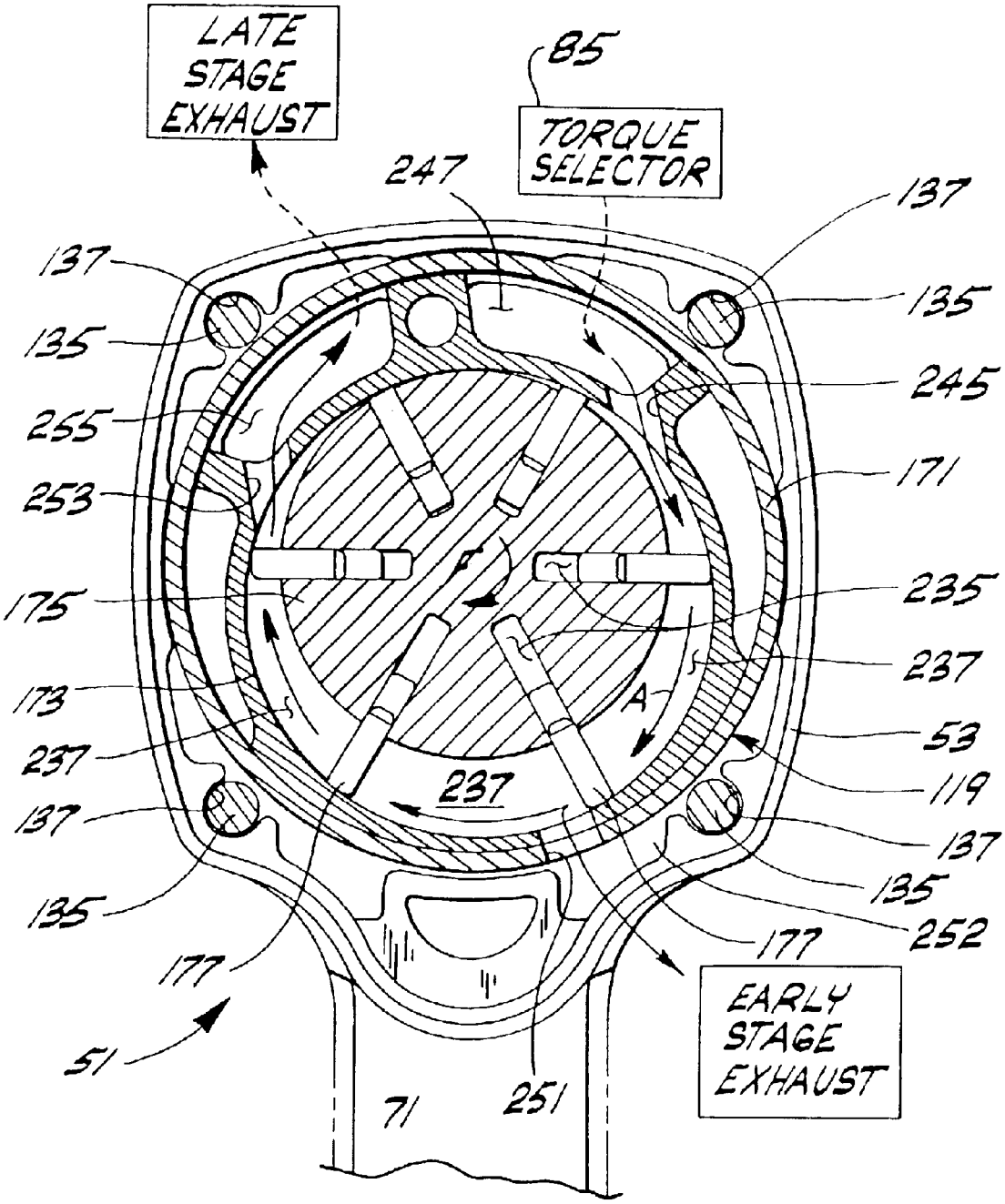
FIG. 17 is a schematic fragmentary section of the tool taken in the plane including line 17—17 of FIG. 1.
Figure 19:
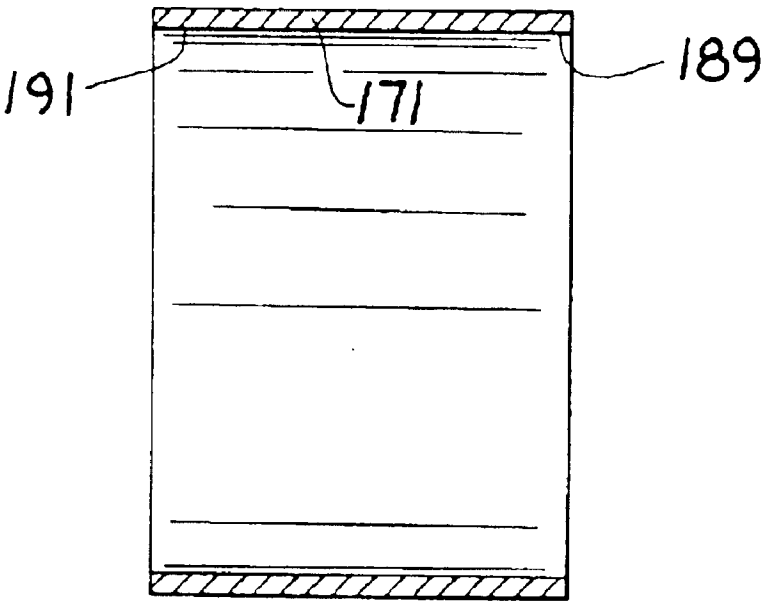
FIG. 19 is a section of the support sleeve taken in the plane including line 19—19 of FIG. 18.
Figure 18:
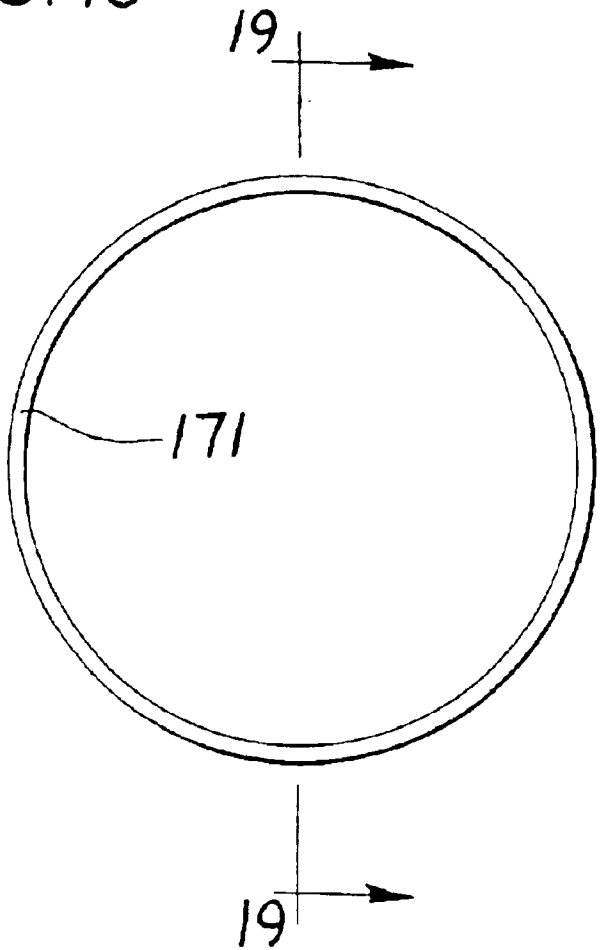
FIG. 18 is an end view of a support sleeve of the tool.
Figure 20:
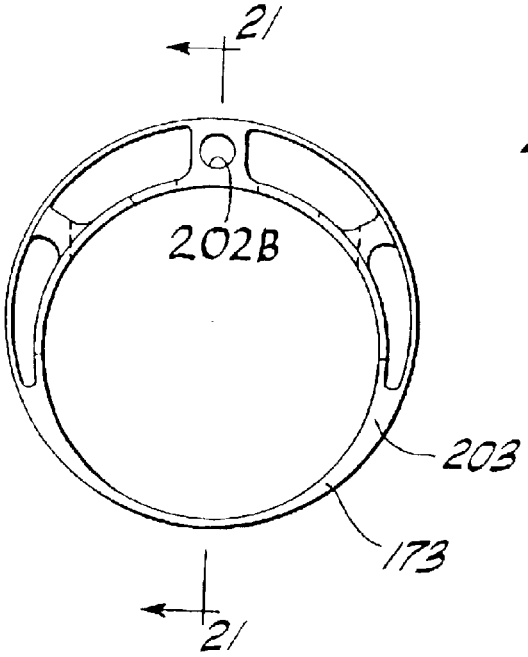
FIG. 20 is a front elevation of a passaging sleeve.
Figure 21:
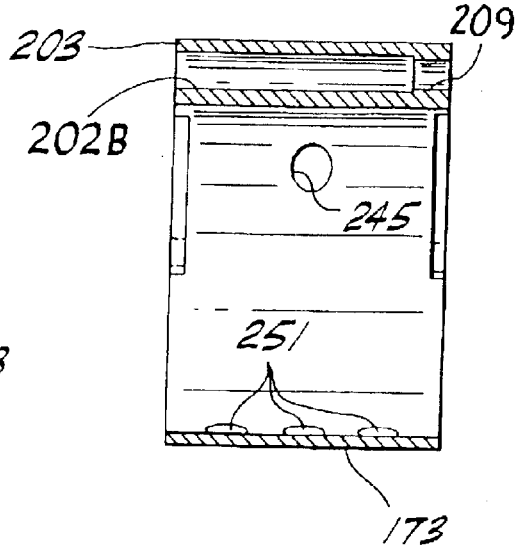
FIG. 21 is a section of the passaging sleeve taken in the plane including line 21—21 of FIG. 20.
Figure 28:
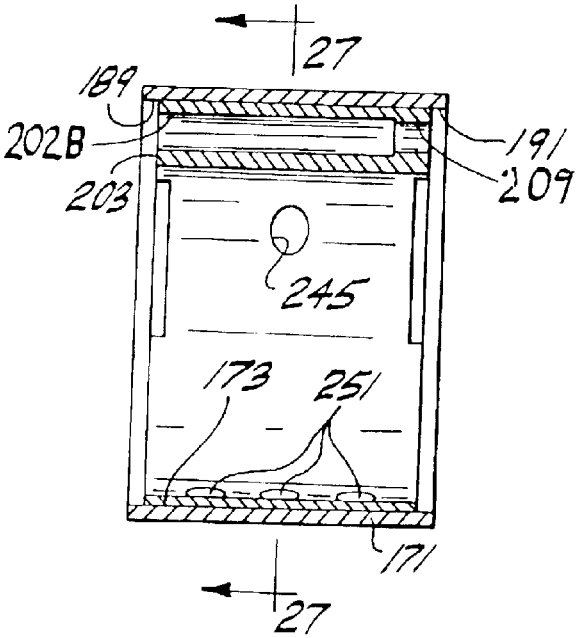
FIG. 28 is a section of the support sleeve and the passaging sleeve taken in the plane including line 28—28 of FIG. 27.
Figure 27:
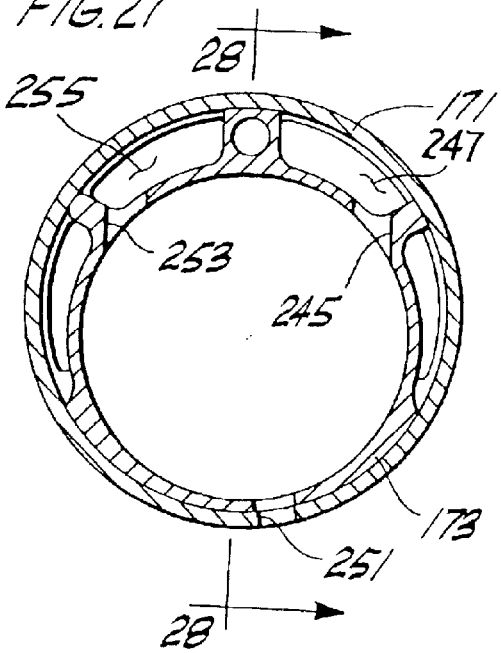
FIG. 27 is a section of the support sleeve and the passaging sleeve taken in the plane including line 27—27 of FIG. 28.

After passing through the first passage 117, torque selector 85 and support plate 168, the pressurized air enters the air motor 119 (FIG. 17). As best shown in FIGS. 3 and 17, the air motor 119 includes a cylindrical support sleeve 171, a passaging sleeve 173, a rotor 175 having a plurality of vanes 177, a first end cap 179 and a second end cap 181. The support sleeve 171 has a first open end 189 and a second open end 191, so that the passaging sleeve 173 mounts within the support sleeve (FIGS. 27 and 28). The first end cap 179 attaches to the first open end 189, and the second end cap 181 attaches to the second open end 191. The first and second end caps 179,181 are formed separately from the support and passaging sleeves 171,173. The end caps 179, 181 and sleeves 171,173 may be economically manufactured as separate pieces. This design contrasts sharply with prior art designs incorporating cup-like motor housings that combine one end cap and the sleeve into a single part. These prior designs are more expensive to manufacture than the present invention because forming a cylinder having one end closed and machining the inside of the cylinder is more costly than forming and machining an open-ended cylinder.

Figure 26:
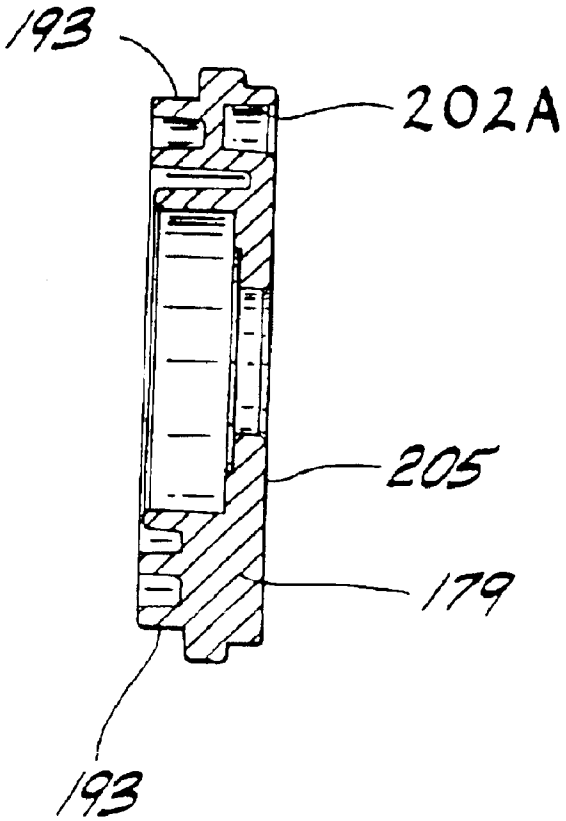
FIG. 26 is a section of the second end cap taken in the plane including line 26—26 of FIG. 25.
Figure 25:
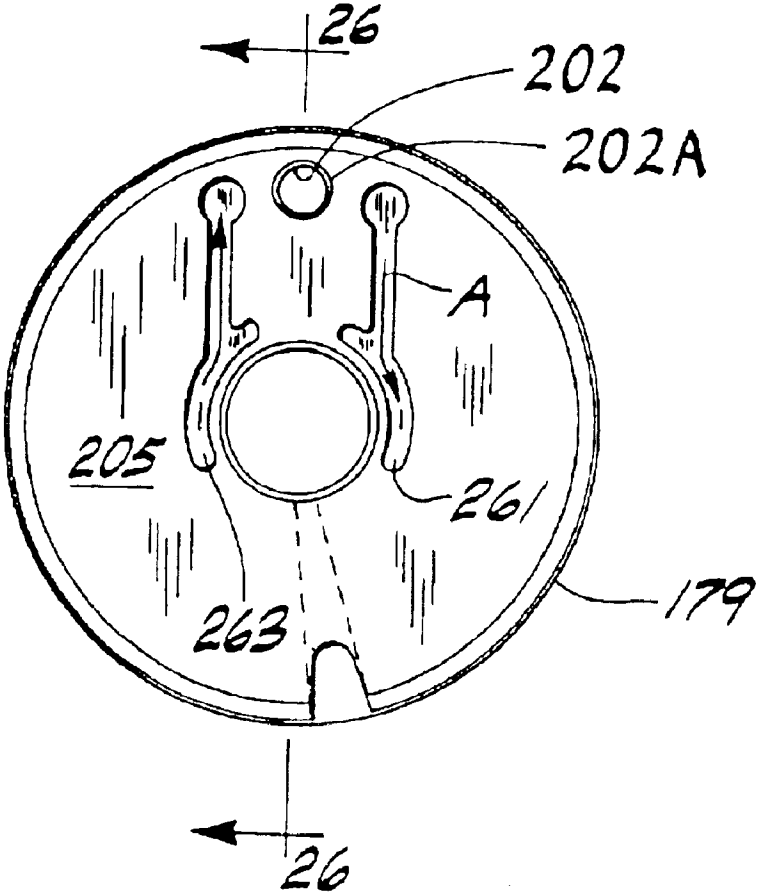
FIG. 25 is a rear elevation of a second end cap.

In the present invention, the end caps 179,181 engage and support the support and passaging sleeves 171,179 against canting with respect to the housing 53 under forces experienced by the tool 51 in use. Three distinct shoulder connections cooperate to rigidly connect the air motor 119, the Maurer Mechanism casing 55 and the housing 53 (FIG. 3). The first end cap 179 has a front external shoulder 193 engageable with a rear internal shoulder 195 of the Maurer Mechanism casing 55. The engagement of the shoulders 193,195 orients the Maurer Mechanism casing 55 and the first end cap 179 so that the two are aligned along their cylindrical axes. In addition, the length of the shoulder 195 helps support the first end cap 179 within the Maurer Mechanism casing 55 to inhibit the two pieces from becoming misaligned should the tool be subjected to a large impact (e.g., if dropped). The first end cap 179 further includes a rear external shoulder 201 engageable with the support sleeve 171 (FIG. 3) and an orientation pin 202 (FIG. 25) having one end received within a hole 202A (FIG. 26) of the first end cap and an opposite end received within a hole 202B of the passaging sleeve 173 (FIG. 28). Orientation pin 202 orients the first end cap 179 and the passaging sleeve 173 with respect to each other. Because both the first end cap 179 and the passaging sleeve 173 are circular, the orientation pin 202 is advantageous upon assembly to properly orient the two parts.

The passaging sleeve 173 is shorter front to rear than the support sleeve 171 so that a front surface 203 of the passaging sleeve 173 is designed for flatwise engagement with a rear surface 205 of the first end cap 179. The support sleeve 171 extends forward beyond this surface, engaging the rear external shoulder 201 of the first end cap 179 and receiving the orientation pin 149 extending from the support plate 168, through a hole 207 in the second end cap 181 and into a hole 209 of the passaging sleeve 173. This shoulder 201 axially aligns the first end cap 179 with the support and passaging sleeves 171,173 and inhibits misalignment of the first end cap and the sleeves. The orientation pin 149 orients the support plate 168, second end cap 181 and passaging sleeve 173, orienting the parts with respect to one another, much the same as with the pin noted above. Finally, the second end cap 181 includes a front external shoulder 211 for engagement with the support sleeve 171 similar to the rear external shoulder 201 of the first end cap 179. The four bolts 135 extending from the end cover 59 to the Maurer Mechanism casing 55 compress the internal components of the tool 51, securely seating the end caps 179,181 on the support sleeve 171. The interaction of the end cover 59, support plate 168, housing 53, support sleeve 171, passaging sleeve 173, end caps 179,181 and Maurer Mechanism casing 55 create a closed cylinder of considerable rigidity and strength. The multiple interlocking shoulder joints and compressive forces induced by the bolts 135 inhibit the air motor 119 from canting with respect to the housing 53. The air motor 119 fits snugly within the housing 53, inhibiting it from canting with respect to the output shaft 57.

The rotor 175 is rotatable within the passaging sleeve 173 (FIGS. 3 and 17). The rotor 175 is of unitary cylindrical construction with a support shaft 213 extending from the rear end of the rotor and a splined shaft 215 extending from the front end of the rotor. The splined shaft 215 has a splined portion 221 and a smooth portion 223. The smooth portion 223 fits within a first ball bearing 225 mounted within the first end cap 179, while the splined portion 221 extends beyond the first end cap and engages the Maurer Mechanism 131. The splined portion 221 of the splined shaft 215 fits within a grooved hole 227 of the Maurer Mechanism 131 which fits within the Maurer Mechanism casing 55 (FIG. 3). The Maurer Mechanism 131 translates the high-speed rotational energy of the rotor 175 into discrete, high-impact moments on the output shaft 57. This allows the user to hold the tool 51 while the tool delivers discrete impacts of great force to the output shaft 57. The Maurer Mechanism 131 is well known to those skilled in the art, so those details will not be included here.

The support shaft 213 fits within a second ball bearing 233 mounted within the second end cap 181 (FIG. 3). The splined shaft 215 and the support shaft 213 extend generally along a cylindrical axis B of the rotor 175, and the two sets of ball bearings 225,233 allow the rotor to rotate freely within the passaging sleeve 173. The axis B of the rotor 175 is located eccentrically with respect to the central axis of the passaging sleeve 173 and has a plurality of longitudinal channels 235 that receive vanes 177 (FIG. 17). The vanes 177 are formed from lightweight material and fit loosely within the channels 235, so that the end caps 179,181 and passaging sleeve 173 limit movement of the vanes 177 longitudinally of the tool within the air motor 119. The vanes 177 extend radially outwardly from the rotor 175 when it rotates, to touch the inside of the passaging sleeve 173. Adjacent vanes 177 create multiple cavities 237 within the motor 119 for receiving compressed air as the rotor 175 rotates. Each cavity 237 is defined by a leading vane 177 and a trailing vane, the leading vane leading the adjacent trailing vane as the rotor 175 rotates. As the cavities 237 pass before an inlet port 245, compressed air pushes against the leading vane 177, causing the rotor 175 to rotate.

As air travels through the air motor 119, the rotor 175 turns, causing the air cavities 237 to move through three stages: a power stage, an exhaust stage and a recovery stage (FIG. 17). Air moves from the torque selector 85 into an intake manifold 247. The pressurized air is then forced through the inlet port 245 formed in the intake manifold 247, allowing air to move into the cavity 237 between the rotor 175 and the passaging sleeve 173. This begins the power stage. As the pressurized air pushes against the leading vane 177, the force exerted on the vane causes the rotor 175 to move in the direction indicated by arrow F. As the volume of air expands in the cavity 237, the rotor 175 rotates, increasing the volume of the space between the vanes 177. The vanes continue to move outward in their channels 235, preserving a seal between the vanes and the passaging sleeve 173.

At the end of the power stage, as the volume of the cavity 237 is increasing toward its maximum amount, the leading vane 177 passes a set of early stage exhaust ports 251 in the passaging sleeve 173 and support sleeve 171 (FIGS. 17, 21, 27 and 28). These ports 251 mark the transition between the power stage and the exhaust stage, allowing expanding air to escape from inside the air motor 119 to an area of lower pressure in interstitial spaces 252 between the air motor and the housing 53. Air leaving these ports 251 is exhausted from the tool 51, as discussed below. During an early portion of the exhaust stage, the volume of the cavity 237 is larger than at any other time in the cycle, expanding to a maximum volume and then beginning to decrease as the cavity moves past the bottom of the motor 119. As the trailing vane 177 passes the early stage exhaust ports 251, some air remains within the air motor 119 ahead of the trailing vane. As the rotor 175 continues turning, the volume of the cavity 237 decreases, increasing the air pressure within the cavity. Compressing this air creates backpressure within the motor 119, robbing the spinning rotor 175 of energy, slowing the rotation of the rotor. To alleviate this backpressure buildup within the motor 119, the end of the exhaust stoke includes a late stage exhaust port 253 which allows the remaining air to escape from the air motor 119 into an exhaust manifold 255. This exhaust air is then routed out of the tool 51 as discussed below. Passing the late stage exhaust port 253 marks the transition to the third stage of the motor 119, the recovery stage, where the volume of the cavity 237 is at its smallest. This stage returns the air vane 177 to the beginning of the power stage so that the motor 119 may repeat its cycle.

Figure 24:
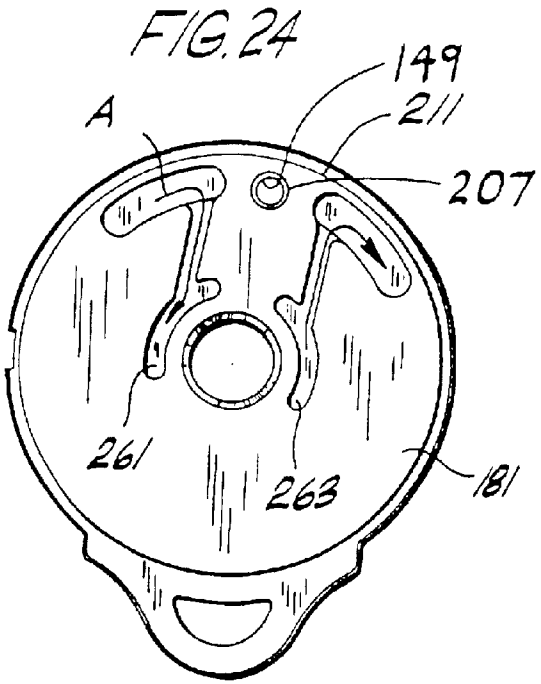
FIG. 24 is a front elevation of the first end cap.
Figure 23:
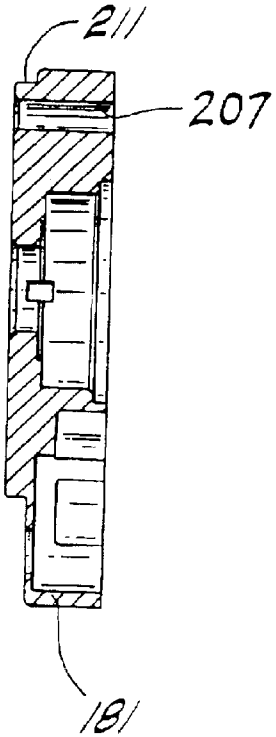
FIG. 23 is a section view of the first end cap taken in the plane including line 23—23 of FIG. 22.
Figure 22:
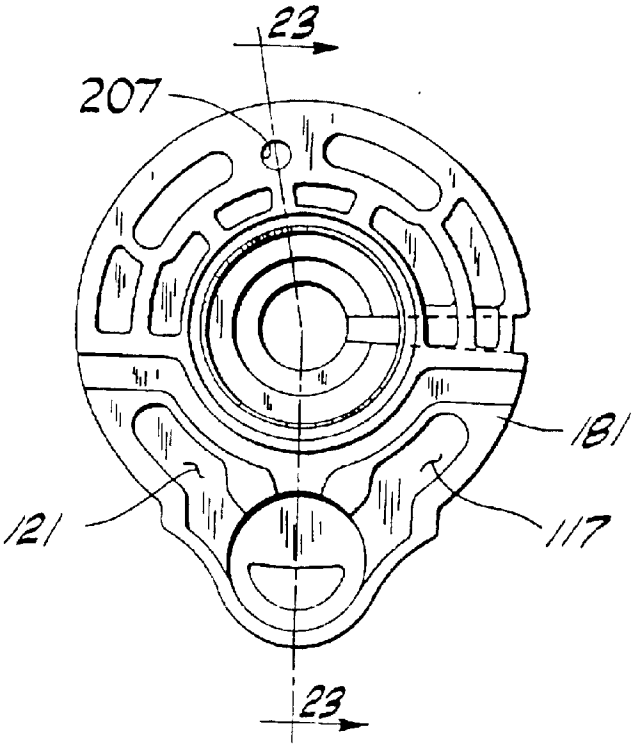
FIG. 22 is a rear elevation of a first end cap.

As the rotor 175 rotates, the vanes 177 continually move radially inward and radially outward in their channels 235, conforming to the passaging sleeve 173 (FIG. 17). The rotation of the rotor 175 forces the vanes 177 radially outward as it rotates, but the vanes may be initially reluctant to move radially outward before the rotor has begun turning at a sufficient rate to push them outward as the rotor turns. This problem may be exacerbated by the presence of required lubricants within the air motor 119. Without the vanes 177 extended from their channels 137, air may simply pass through the air motor 119 to the early stage exhaust valve 251 without turning the rotor 175 as desired. To counteract this effect, the first end cap 179 (FIGS. 25 and 26) and the second end cap 181 (FIGS. 22–24) each include a vane intake channel 261. Some pressurized air in the intake manifold 247 passes through these vane intake channels 261 at either end of the air motor 119. The air moves within the channel 261 behind the vanes 177 to push the vanes out of the channels 235 so that air passing through the motor 119 can press against the extended vanes. The vane intake channels 261 deliver air to each vane 177 as it moves through most of the power stage. The intake channel 261 ends once the vane 177 nears full extension from the channel 235. After the vane 177 begins moving back inward toward the axis of the rotor 175, the air behind the vane must escape, so vane outlet channels 263 are formed on the first end cap 179 and the second end cap 181. These allow the air behind the vane 177 to move through the channel 263 and into the exhaust manifold 255. The air may then exit the motor 119 in the same manner as the air exiting the late stage exhaust port 253.

Returning to the exhaust air exiting the early stage exhaust port 251, the air then passes through a pair of orifices (not shown) in the housing 53 which lead to the air exhaust 91 in the grip 71 (FIG. 3). Exhaust air exiting the late-stage exhaust port 253 or one of two vane outlet channels 263 and entering the exhaust manifold 255 exits the tool 51 by a different path (FIG. 4). This path guides the air through the second passage 121 back toward the rotation selector valve 83, which diverts it to two symmetrical overflow passages 269 which lead to interstitial spaces 252 between the support sleeve 171 and first end cap 179 and the housing 53 (FIG. 4). The remaining exhaust air then travels through these spaces 252 to the pair of orifices and out the air exhaust 91 as with the other exhaust air.

Operating in the reverse direction, the tool 51 works substantially the same, except that the air bypasses the torque selector 85. Air enters the tool 51 through the same air inlet 81. The rotation selector valve 83 diverts the air to the second passage 121 where the air travels upward through the tool 51 until it enters the exhaust manifold 255. The air then passes through the late-stage exhaust port 253 and enters the air motor 119 where it reacts on the opposite side of the vanes 177, thereby applying force to the rotor 175 in the opposite direction. The early-stage exhaust port 251 operates substantially the same as in the forward direction. The vane intake channel 261 and vane outlet channel 263 operate as before, except that they allow air to flow in opposite directions.

Typically, pneumatic rotary tools are almost entirely formed from a high strength metal such as steel. These tools are subjected to high stress and loading from proper use plus discrete impacts from being dropped or bumped. Although metal, such as steel, provides adequate strength, a significant drawback of an all-metal construction is the high weight and material cost. The design of the current invention eliminates these problems by forming the tool housing 53 from lightweight and inexpensive plastic. In addition, the design of the support sleeve 171 and the end caps 179,181 eliminates the need for machining expensive cup-like parts for the air motor. Such parts were a significant drawback of the prior art. The present invention employs a simple sleeve 171 and end cap 179,181 design that can withstand the impact loads of use with parts not requiring elaborate machining techniques as with the prior art. Moreover, the sleeve 171 and end cap 179,181 design is resistant to canting within the tool 51 because of the four bolts 135 and shoulder engagements between the parts.

The present invention is also directed to a method of assembling the pneumatic rotary tool 51 of the present invention. The tool 51 is designed for easy assembly according to the following method. The method described below is applicable to the tool 51 and its various parts as described above. The air motor 119 is assembled by engaging the rear external shoulder 201 of the first end cap 179 with an end of the support sleeve 171. The rotor 175 is then seated within the support sleeve 171 so that the splined shaft 215 extends outward through the first end cap 179. A plurality of vanes 177 are then inserted lengthwise into channels 235 of the rotor 175 for rotation with the rotor inside the sleeve 171. The second end cap 181 then engages the opposite end of the support sleeve 171 and the support shaft 213 for rotation of the rotor 175 within the sleeve, thereby completing construction of the air motor 119. The completed air motor 119 is then inserted into the housing 53.

The Maurer Mechanism 131 is then inserted into the Maurer Mechanism casing 55 so that the output shaft 57 of the Maurer Mechanism extends from the casing. The gasket 67 mounts on the back end 65 of the Maurer mechanism casing, and includes four bolt openings 273 for receiving the bolts 135 before they enter the holes of the Maurer Mechanism casing (not shown). The back end 65 of the Maurer Mechanism casing 55 may then be engaged with the housing 53 for connection of the Maurer Mechanism 131 to the splined shaft 215 of the air motor 119. The Maurer Mechanism 131 will then rotate conjointly with the rotor 175 of the air motor 119. The support plate 168 and end cover 59 then seat on the rear of the housing 53, thereby enclosing the air motor 119 within the tool housing.

To secure the Maurer Mechanism casing 55, housing 53, support plate 168 and end cover 59 together and ensure that the air motor 119 remains properly oriented within the housing, the plurality of bolts 135 are inserted through the end cover, support plate and housing. As described above, these bolts 135 thread into the rigid Maurer Mechanism casing 55, drawing the support plate 168 and end cover 59 toward the housing 53 and the housing toward the Maurer Mechanism casing. These rigid bolts 135 and the rigid Maurer Mechanism casing 55 compress the tool 51, including compressing the end caps 179,181 and support sleeve 171 of the air motor 119 within the housing 53 to fully seat the end caps onto the support sleeve so that the motor, housing, support plate 168 and end cover 59 cooperate to hold the air motor in proper alignment within the tool. In other words, the air motor 119 is sandwiched between two rigid components, the support plate 168 and the Maurer Mechanism casing 55. The support plate 168 further supports the plastic end cover 59 to inhibit bending and encouraging uniform motor 119 support during tool 51 use. The method described herein is preferred, although it is contemplated that the method steps may be reordered while remaining within the scope of the present invention.

The method preferably comprises another step where the housing 53 is formed by delivering flowable plastic to a mold to form the housing. The flowable plastic enters the mold and surrounds the air inlet 81 of the tool 51, creating the tool housing 53 with an air inlet cylinder having an interference fit within the housing. As discussed above, the inlet cylinder 81 allows source air to enter the tool 51 for use by the air motor 119. Other methods of forming a plastic housing 53 around an air inlet cylinder 81 are also contemplated as within the scope of the present invention. The method also preferably comprises a step of overmolding an outer layer 73 of soft material onto a portion of the housing 53 constituting a grip 71, after the step of molding the housing.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A pneumatic rotary tool comprising:

a housing formed substantially from plastic;

an air motor disposed within the housing, the air motor comprising a casing having closed ends and a rotor mounted on the casing at said closed ends for rotation relative to the casing;

a first rigid support of a material more rigid than the plastic housing, the first rigid support engaging the air motor and the housing generally at one end of the motor;

a second rigid support of a material more rigid than the plastic housing, the second rigid support engaging the air motor and the housing generally at an opposite end of the motor, the first and second rigid supports supporting the air motor from movement and misalignment within the housing.

2. A tool as set forth in claim 1 wherein the second rigid support comprises a plate interposed between the air motor and the plastic housing.

3. A tool as set forth in claim 2 wherein the second rigid support is made of metal.

4. A tool as set forth in claim 3 wherein the second rigid support is a metal plate having an exterior layer of an elastomeric material and sealingly engaging the air motor and the plastic housing.

5. A tool as set forth in claim 3 wherein the first rigid support comprises a metal casing and wherein the tool further comprises an output shaft engaged for rotation by the motor and disposed in the casing.

6. A tool as set forth in claim 5 wherein the first rigid support is an impact clutch device.

7. A tool as set forth in claim 1 further comprising fasteners extending through the housing and interconnecting the first and second rigid supports, the fasteners clamping the air motor between the first and second rigid supports.

8. A tool as set forth in claim 7 wherein the fasteners are bolts.

9. A tool as set forth in claim 8 wherein said housing includes an end cover mounted on the housing such that the second rigid support is received between the end cover and the housing, the bolts are received through the end cover such that the second rigid support and the housing cooperate to provide uniform support of the air motor to resist movement of the air motor with respect to the housing when the housing is subjected to an impact.

10. A tool as set forth in claim 9 wherein the second rigid support includes passage openings for fluidly connecting the end cover and the housing.

11. A tool as set forth in claim 1 wherein the air motor casing comprises a support sleeve, a first end cap substantially closing a first end of the support sleeve and a second end cap substantially closing a second end of the support sleeve.

12. A tool as set forth in claim 11 further comprising fasteners extending through the housing and interconnecting the first and second rigid supports, the fasteners clamping the air motor casing between the first and second rigid supports.

13. A pneumatic rotary tool comprising:

an air motor;

the air motor including a rotor and substantially closed ends, the substantially closed ends being adapted to support the rotor;

a housing formed substantially from plastic;

the housing including an end cover formed substantially from plastic for covering a rear portion of the tool; and a support formed from a material more rigid than the end cover for engaging and supporting the end cover from movement and deflection.

14. A tool as set forth in claim 13 wherein support comprises a plate interposed between the air motor and the end cover.

15. A tool as set forth in claim 14 wherein the plate is made of metal.

16. A tool as set forth in claim 15 wherein the plate has an exterior layer of an elastomeric material for sealingly engaging the air motor and the plastic housing.

17. A tool as set forth in claim 13 wherein the air motor includes a casing, the casing comprising a support sleeve, a first end cap substantially closing a first end of the support sleeve and a second end cap substantially closing a second end of the support sleeve.

18. A tool as set forth in claim 13 wherein the end cover comprises at least one air passage, and wherein the support comprises at least one passage in fluid communication with the air passage of the end cover and the air motor thereby allowing airflow to the air motor for rotating the rotor.

19. A tool as set forth in claim 18 further comprising a torque selector mounted in the end cover for regulating airflow to the motor.

20. A tool as set forth in claim 18 further comprising a rotation selector valve rotatable within the end cover for selectively altering the direction of rotation of the rotor.

21. A pneumatic rotary tool comprising:

a housing formed substantially from plastic;

an air motor disposed within the housing;

a first rigid support of a material more rigid than the plastic housing, the first rigid support engaging the air motor and the housing generally at one end of the motor;

a second rigid support of a material more rigid than the plastic housing, the second rigid support engaging the air motor and the housing generally at an opposite end of the motor, the first and second rigid supports supporting the air motor from movement and misalignment within the housing, wherein the second rigid support comprises a metal plate interposed between the air motor and the plastic housing, the metal plate having an exterior layer of an elastomeric material and sealingly engaging the air motor and the plastic housing.

22. A pneumatic rotary tool comprising:

a housing formed substantially from plastic;

an air motor disposed within the housing;

a first rigid support of a material more rigid than the plastic housing, the first rigid support engaging the air motor and the housing generally at one end of the motor;

a second rigid support of a material more rigid than the plastic housing, the second rigid support engaging the air motor and the housing generally at an opposite end of the motor, the first and second rigid supports supporting the air motor from movement and misalignment within the housing;

fasteners extending through the housing and interconnecting the first and second rigid supports, the fasteners clamping the air motor between the first and second rigid supports;

said housing including an end cover mounted on the housing such that the second rigid support is received between the end cover and the housing, the fasteners are received through the end cover such that the second rigid support and the housing cooperate to provide uniform support of the air motor to resist movement of the air motor with respect to the housing when the housing is subjected to an impact.

* * * * *